US005267620A

United States Patent [19]

Lee

[11] Patent Number: 5,267,620

[45] Date of Patent: Dec. 7, 1993

[54] DRILLING LATCH APPARATUS

[75] Inventor: Kevin J. Lee, West Valley City, Utah

[73] Assignee: Longyear Company, Salt Lake City, Utah

[21] Appl. No.: 865,355

[22] Filed: Apr. 8, 1992

Related U.S. Application Data

[63] Continuation-in-part of Ser. No. 694,338, May 1, 1991.

[51] Int. Cl.[5] ..... E21B 25/02

[52] U.S. Cl. ..... 175/230; 175/246

[58] Field of Search ..... 175/20, 230, 246, 247, 175/251, 254, 403

[56] References Cited

U.S. PATENT DOCUMENTS

| | | | |
|---|---|---|---|
| 1,326,509 | 12/1919 | Humason . | |
| 1,987,119 | 10/1934 | Walker . | |
| 2,829,868 | 4/1958 | Pickard et al. | 175/246 |
| 2,905,438 | 9/1959 | Church . | |
| 3,103,981 | 9/1963 | Harper | 175/246 X |
| 3,120,283 | 2/1964 | Braun | 175/246 |
| 3,266,835 | 12/1966 | Hall et al. . | |
| 3,305,033 | 2/1967 | Pickard et al. | 175/246 |
| 3,333,647 | 8/1967 | Karich et al. . | |
| 3,346,059 | 10/1967 | Svendsen . | |
| 3,461,981 | 8/1969 | Casper et al. | 175/246 |
| 3,485,310 | 12/1969 | Milosevich | 175/246 |
| 3,777,826 | 12/1973 | Wolda | 175/46 |
| 3,977,482 | 8/1976 | Reed et al. | 175/246 |
| 4,418,770 | 12/1983 | Lambot | 175/58 |
| 4,466,497 | 8/1984 | Soinski et al. | 175/246 |
| 4,800,969 | 1/1989 | Thompson | 175/246 |
| 4,832,138 | 5/1989 | Hallez . | |
| 4,834,198 | 5/1989 | Thompson . | |

FOREIGN PATENT DOCUMENTS 742576 10/1986 U.S.S.R. ..... 175/246

*Primary Examiner*—William P. Neuder
*Attorney, Agent, or Firm*—Clayton R. Johnson

[57] ABSTRACT

A drilling tool, for example a core barrel inner tube assembly or a drilling bit, is attached to the inner end of a latch body which is removably seatable on a landing shoulder of a drill string. A latch retractor is mounted to the latch body for limited axial movement and has a latch assembly chamber opening inwardly to the closed end of the tubular portion of the latch body. The latch assembly includes a rigid transverse link that at opposite ends dependingly pivotally mount a pair of latches, there being no mechanical attachment of the assembly to the retractor or latch body. A transverse stop member limits the latch lateral sections movement inwardly toward the other from a latch seated position to a latch retracted position. At the inner end of the retractor, there are angularly spaced flanges extending radially toward the other in the chamber for retracting the latches as the retractor is withdrawn. The flanges are spaced to permit the assembly being extended therebetween and into the chamber. After the latches are extended angularly between the flanges and moved axially into the chamber, the latches are retracted and rotated about the central axis about 90 degrees, the retractor is extended into the tubular portion and the stop member is mounted to the latch body to extend between the latches.

44 Claims, 8 Drawing Sheets

T
H
F
79
202
217
231
30
204
202b
218
54
215
210
202a
221
203
245
247
248
249
234
243
244
253
214b
252
217a
217c
217b
212
219

DRILLING LATCH APPARATUS

BACKGROUND OF THE INVENTION

RELATED APPLICATION

This application is a continuation in part application of my application Ser. No. 07/694,338, filed May 1, 1991.

The present invention relates to drilling apparatus and more particularly to latch mechanism for releasably retaining a core barrel inner tube assembly, plug bit drilling assembly and similar apparatus in a drill string in an earth formation.

In U.S. Pat. No. 3,346,059 to Svendsen there is disclosed a core barrel inner tube assembly having a pair of latches that are reciprocally movable perpendicular to the axis of elongation of the assembly between a latching and a retracted position by a latch bar having transversely adjacent surfaces divergingly inclined in an axially outwardly direction and in part extending between transversely opposite surfaces of the latches for retracting the latches as the bar is moved outwardly.

U.S. Pat. No. 2,905,438 to Church discloses a spearpoint having the one ends of a pair of links pivotally connected thereto, the opposite ends of the links being pivotally connected to the mid-portions of the latches. One end of each latch is pivotally connected to the core barrel cap. The only connection of the spearpoint to the cap is through the pivotal connections of the latches to the cap and the pivotal connections of the links to the spearpoint. Pulling the spearpoint upwardly pivots the links to retract the latches. In Church and other prior art latching devices the latches in their latch seated condition are in a generally "Y" or "V" configuration that opens axially outwardly. As the spearpoint (latch retracting member) is moved upwardly the movement of the spearpoint acts to pull the latches more tightly against the drill string latch seat shoulder. As a result in, for example, a core blockage situation resulting in the latch body forcing the latches against the latch seat, the pulling force exerted on the spearpoint pulls the latches more firmly against the latch seat. This makes it more difficult, if possible, to retract the core barrel inner tube assembly.

In Hall, U.S. Pat. No. 3,266,835, the spearpoint is mounted by a rod which has a transverse slot through which a pin is extended, the pin being connected to a ring that retracts the latch fingers when the spearpoint is moved upwardly. Walker, U.S. Pat. No. 2,035,852, discloses an overshot assembly having the lower parts of arms of the jaws pivotally connected to the overshot body arm pivot. The upper ends of the arms are pivotally connected to one ends of the links while the opposite ends of the links are connected to the pull rod by a rod pivot. A spring is Connected between the arm pivot and the rod pivot to resiliently urge the pivots together and thereby the lower ends of the arms apart to permit the collapsible bit trip member moving therebetween. In the prior art assemblies such as U.S. Pat. Nos. 1,326,509 to Humason and 3,103,981 to Harper wherein the latches are pivotally mounted in transverse side by side relationship, the area of the latches bearable against the latch seat shoulder is less than desirable and as a result the wear on the lock coupling is greater than that which would occur if there were larger transverse areas bearing against the latch seat shoulder (lock coupling shoulder). Further with the side by side transverse relationship, the strength of the latches is more limited than desired as a result of the side by side mounting limiting the transverse cross section area of the latches that takes the load.

In U.S. Pat. No. 4,834,198 to Thompson there is provided valving mechanism in an inner tube assembly for movement between a position whereby the inner tube assembly is inwardly fluidly propellable toward the bit end of the drill string, a position that bypass fluid may enter an inner bypass channel port and exit through an outer bypass channel port as the inner tube assembly moves toward the drill bit and after the inner tube assembly has seated on the landing ring and the pump-in pressure is sufficiently decreased, a position that a fluid bypass channel is opened.

U.S. Pat. No. 3,333,647 to Karich et al discloses a core barrel tube inner tube assembly that is fluidly propellable to the bit end of the drill string, a stop pin abutting against the outer end portions of the latches to block the inward movement of the latch release member relative to the latch body to a position permitting fluid bypass flow until the latches pivot to their latch seated position and thence permit the release tube moving inwardly to permit the washer flexing to allow substantial fluid flow bypassing the inner tube assembly. U.S. Pat. No. 3,120,283 to Braun also discloses underground wire line core barrel structure wherein a latch release tube moves to an axial inner position after the latches move to a latched position to open a fluid bypass flow channel.

In order to make improvements in latching mechanism for drilling apparatus that includes, for example, wire line core barrel tube assemblies, retractable drag bits and earth sampling tubes that are retractable through a drill string and/or an outer barrel, this invention has been made.

SUMMARY OF THE INVENTION

A drilling assembly movable in a drill string to the inner end portion thereof for being latchingly retained therein includes a latch body having an outwardly opening chamber in which a latch retractor is mounted for limited axial movement relative thereto for retracting the latches of the latch assembly from a latch seated position against the resilient action of a spring that urges the latches to move toward the latch seated position. The latches are free floating in the retractor chamber of the latch retractor in that there is no mechanical connection between the latch assembly and either of the latch body and the retractor, a pin being extended through the latch body chamber to retain the latch assembly extending within the retractor chamber. A drilling tool is attached to the latch body to extend inwardly thereof, the tool being any one of, for example, a core barrel inner tube, a plug bit, an earth sampling tube, and etc. Preferably the latches in each of their latch seating and latch retracted positions are radially spaced from one another throughout their axial lengths, there being only a single pivotal connection to each latch.

In one embodiment a plunger (valving mechanism) is provided that is released to move axially inwardly of the latches once the latches have moved to their latch seated position to first partially block the fluid bypass channel and upon a substantial build up of fluid pressure in the drill string, moves to a second position to fully open the bypass channel to provide a signal at the drilling surface that the inner tube assembly has landed on the landing ring and that the latches have moved to their proper latch seated position.

One of the objects of this invention is to provide in drilling apparatus a new and novel latching assembly. A further object of this invention is to provide new and novel latching means for a drilling assembly to facilitate the movement of the latches to a retracted position regardless of the axial pressure applied thereto when the drilling assembly is latchingly retained in the inner end of the drill string. Another object of this invention is to provide new and novel drilling apparatus latching mechanism for reducing the wear on the drill string latch recess outer shoulder. An additional object of this invention is to provide new and novel latching means that has a very great mechanical advantage during the initial application of retraction force, if needed, and thereafter a reduction of the mechanical advantage.

Still another object of this invention is to provide a new and novel latch assembly and latch retractor for acting in cooperation with a latch body to mount the latch assembly including its latch and pivot for axial movement and the latch for pivotal movement relative to the latch body between a latch seated position in a drill string latch seat and a latch retracted position. A further object of this invention is to provide new and novel latch mechanism in an underground core barrel inner tube assembly.

In furtherance of one or more of the above objects, a different object is to provide new and novel valving mechanism for cooperating with inner tube assembly latches for providing an indication to the driller that the inner tube assembly head has seated on the drill string landing shoulder and that latches are properly seated in the latch seat. Another object of this invention is to provide new and novel valving means in a retractable wire line core drilling assembly for being couplingly engaged by retractable latches to retain an open fluid bypass channel during the assembly inward movement in a drill string and upon the latch mechanism moving to a latch seated position in a drill string latch recess, disengaging the coupling engagement with the valving mechanism. In furtherance of the last mentioned object, it is still another object of the invention to provide in a latch body new and novel means for cooperating with the valving means to provide a high pressure signal when the assembly is seated on a drill string landing shoulder and the latch mechanism has moved to its latch seated position, initially block the bypass channel until the downward fluid pressure builds up in the drill string to provide a high pressure signal at the drilling surface and thence opens the bypass channel so that the fluid pressure in the drill string drops.

For purposes of facilitating the description of the invention, the term "inner" refers to that portion of the drill string, or of the assembly, or an element of the assembly being described which in its position "for use" in, or on, the drill string is located closer to the drill bit on the drill string (or bottom of the hole being drilled) than any other portion of the apparatus being described, except where the term clearly refers to a transverse or circumferential direction, or diameter of the drill string or other apparatus being described. The term "outer" refers to that portion of the drill string, or of the assembly, or an element of the assembly being described which in its position "for use" in, or on, the drill string is located axially more remote from the drill bit on the drill string (or bottom of the hole being drilled) than any other portion of the apparatus being described, except where the term clearly refers to a transverse circumferential, direction, or diameter of the drill string or other apparatus being described.

Figure 1:
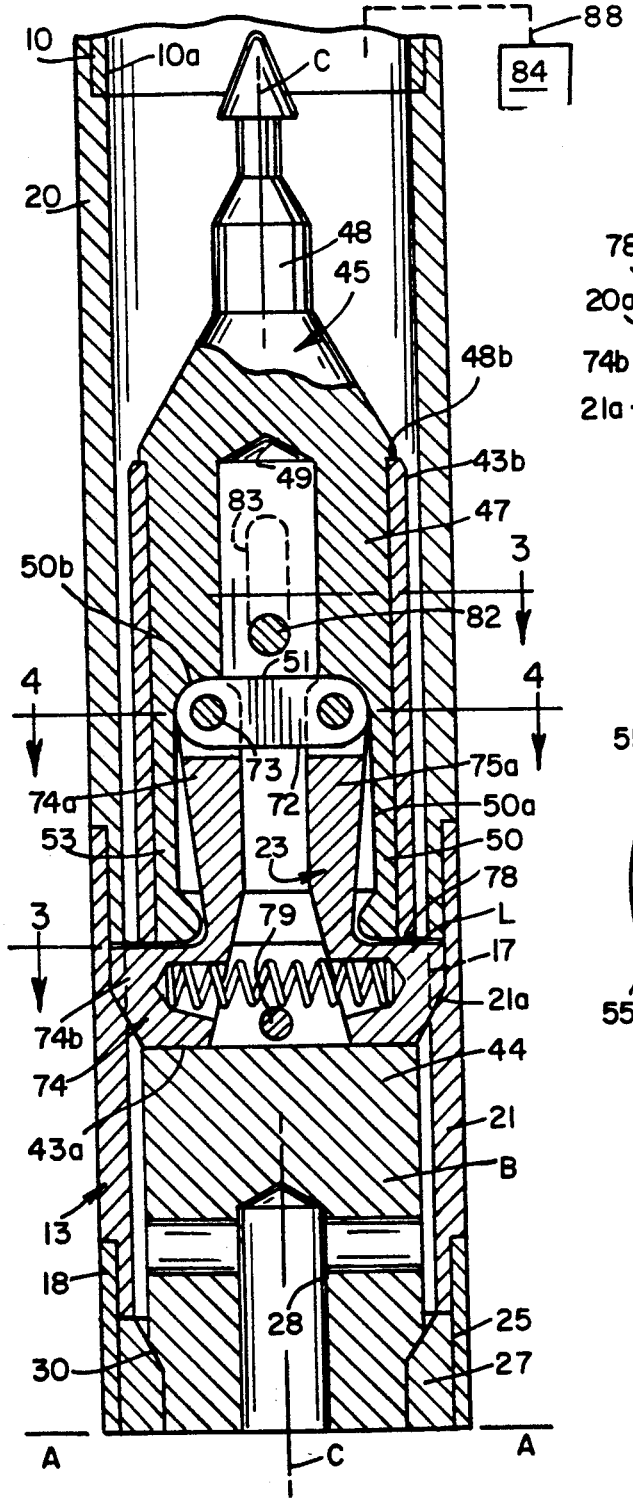
FIGS. 1 and 2 with FIG. 1 arranged above FIG. 2, the axial center lines aligned and lines A—A and B—B aligned, form a composite longitudinal section through the first embodiment of the drilling apparatus with the latches being in a latch seated position and various axial intermediate portions broken away, these views being generally taken along the line and in the direction of the arrows 1—1 of FIG. 4.
Figure 6:
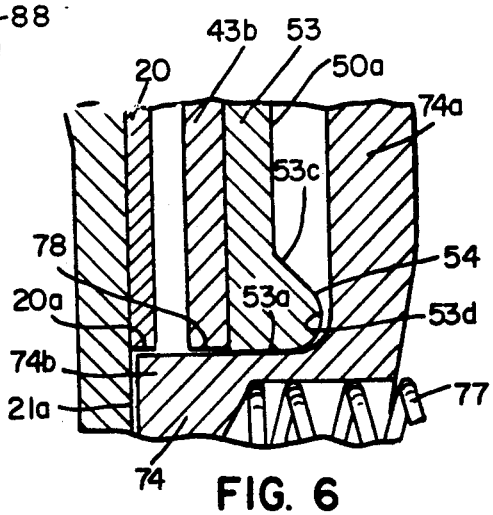
FIG. 6 is an enlarged view of a portion of the structure of FIG. 1.
Figure 2:
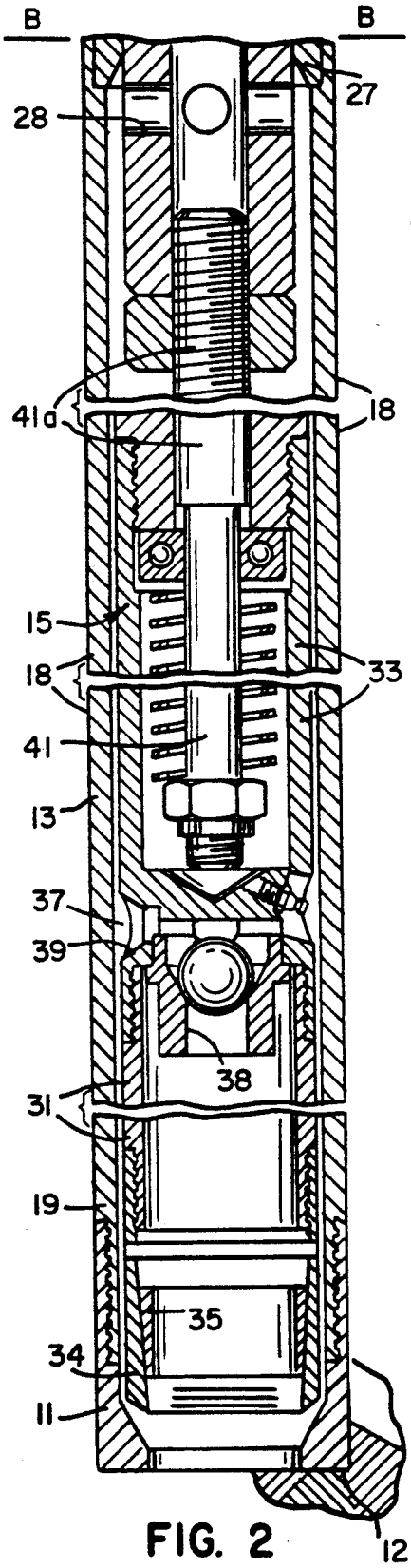
Figure 3:
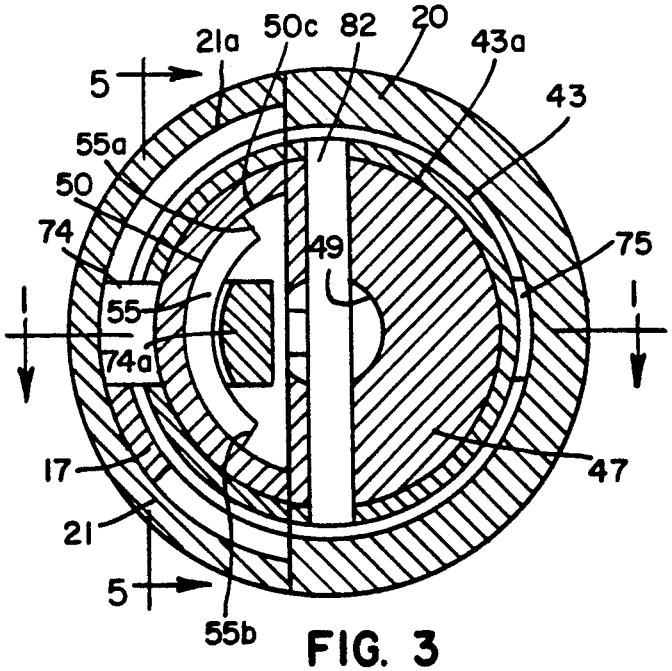
FIG. 3 is a transverse cross sectional view generally taken along the lines and in the direction of the arrows 3—3 of FIG. 1.

Referring now in particular to FIGS. 1-3, there is illustrated a hollow drill string 10 which is made up of a series of interconnected hollow drill rods (tubes). The drill string 10 is in a downwardly extending bore hole 12 drilled in rock or other types of earth formations by means of an annular core bit 11. The pump apparatus indicated by block 84 pumps fluid under pressure through line 88 into the upper end of the drill string 10 in a conventional manner, the illustrated part of the drill string 10 in FIG. 1 being located just upstream of the bit in the bore hole 12 and may be at a considerable depth below the surface.

The portion of the drill string attached to or extended below the pipe (rod) section 10*a* is commonly referred to as a core barrel outer tube assembly, generally designated 13; the core barrel outer tube assembly being provided for receiving and retaining the core barrel inner tube assembly, generally designated 15. Details of the construction of the core barrel outer tube assembly of the general nature used in this invention may be such as that disclosed in U.S. Pat. Nos. 3,120,282 and 3,120,283. The outer tube assembly is composed of an adaptor coupling 21 that is threadedly connected to the core barrel outer tube 18 to provide a recess in which a landing ring (drill string landing shoulder) 27 is mounted, a reaming shell 19 connected to the inner (lower) end of tube 18 and an annular drill bit 11 at the lower end of the reaming shell for drilling into the earth formation from which the core sample is taken. The upper end of the assembly 13 includes a locking coupling 20 that connects the adaptor coupling to the adjacent pipe section 10*a* of the drill string. At the opposite end of the coupling 20 from the pipe section 10*a* , the locking coupling in conjunction with the annular recess 21*a* of the coupling 21 form a latch seat 21*a* inside of the surface of the adaptor coupling against which the latches 74, 75 of the latch assembly L are seatable for removably retaining the core barrel inner tube assembly, generally designated 15, adjacent to the core bit. The inner end portion of the locking coupling may have a projection flange 17 which extends as a partial cylindrical surface more closely adjacent to the core bit than to the main part of said coupling. This flange bears against a latch to cause the latches and other portions of the inn-r tube assembly to rotate with the drill string when the latches are in a latched position as is conventional.

The core barrel inner tube assembly 15 includes a wire line retractable head assembly having a latch body B, a retractor 45 and a latch assembly 23. The latch body B has a main body portion 44 with a conventional annular, downwardly facing shoulder 30 seatable on the landing ring (drill string landing shoulder) 27 and a fluid bypass channel 28 to permit fluid flow to bypass the landing ring when the shoulder 30 is seated on the ring 27. That is, the portion of the inner tube assembly from the shoulder 30 and axially inwardly thereof is of a smaller diameter than at least the axial part of the main body outwardly of and adjacent to the shoulder while the channel has a port opening exterior of the latch body outwardly of the shoulder and a second port opening exterior of the latch body inwardly of the shoulder. Suitable valving (not shown) may be provided for blocking flow through the channel, for example of the type referred to in U.S. Pat. No. 3,103,981 to Harper or U.S. Pat. No. 4,800,969 to Thompson. The assembly 15 also includes a core receiving tube 31, an inner tube cap 33 threaded into the upper end of the core receiving tube, and a spindle and bearing subassembly 41 for connecting the cap to the lower portion of the latch body. The subassembly 41 includes a spindle bolt 41*a* threadedly connected to the inner end portion of the latch body, and connects the cap to the latch body for limited movement in a conventional manner. The core receiving tube has a replaceable core lifter case 34 and a core lifter 35, the structure and function of which may be generally the same as set forth in U.S. Pat. No 2,829,868. A fluid passageway 39 formed in the cap 33 opens through a valve subassembly 38 to the interior of the outer end of the core receiving tube and at the opposite end to the annular clearance space 37 between the inner tube assembly and the outer tube 18 that forms a part of the annular fluid channel 37 to, in conjunction with the bypass channels, permit fluid to bypass the inner tube assembly when in a core taking position such as illustrated in FIG. 1-3. The cap 33 is mounted by the spindle-bearing subassembly 41, the subassembly 41 and the manner of the mounting thereof being very similar to that described in greater detail in U.S. Pat. No. 3,305,033.

The latch body has an axial outer tubular portion **43*b* that in part defines an axially elongated chamber 43 opening through the outer end thereof to have a latch retractor (latch release member), generally designated 45 axially slidably extended therein. The chamber 43 is axially outwardly of the bypass channel 28 and opens inwardly to the latch body transverse, generally planar wall 43*a* at the juncture of the latch body outer tubular portion 43*b* with the latch body main (inner) portion 44, the portion 44 extending axially inwardly of the tubular portion 43*b***.

The retractor includes an outer spearpoint portion (overshot coupling member) 48 joined to the retractor main body 47 at a downwardly facing annular shoulder **48*a* abuttable against the outer terminal edge of the latch body tubular portion 43*b* to limit the axial inward movement of the retractor toward the wall 43*a* to a position axially outwardly spaced from the wall 43*a***.

The retractor main body has an axial outer, transversely centered bore 49 that is closed at its outer end, at its inner end opens to the latch assembly chamber 50 and is of a smaller diameter than the chamber to at their intersection provide a transverse, generally planar annular shoulder 51 that faces axially inwardly and is generally parallel to the wall **43*a*. The chamber 50 opens downwardly through the retractor inner transverse, annular terminal edge 53*a* toward the wall 43*a*, the edge 53*a* being substantially parallel to the wall 43*a*. The chamber 50 also is in part defined by the retractor wall 50*a* of the inner annular portion 53 of the retractor that, other than for diametric opposite latch retracting flanges 54, 55, is circular cylindrical from the edge 53*a* to the annular, semi-torus wall 50*b* that extends axially between shoulder 51 and wall 50*a* . Thus the inner end portions 50*c* of the wall 50 which are angularly between the flanges are radially curved to be of the same diameter as the rest of the chamber 50 axially from the edge 53*a* to the wall 50*b*. The axial dimension of wall 50*a* between the semi-torus wall and the flanges is several times greater than the combined axial dimensions of the semi-torus wall and the flanges. The flanges are transversely and arcuately spaced from one another, extend transversely toward one another, and are transversely Circularly arcuately curved. In axial cross section, each flange may be tapered axially inwardly and radially inwardly from along surface 50*c* (frustoconical) at an angle, for example about 40 to 50 degrees, to the radially curved surface 50*d* which in turn extends to intersect edge 53*a***.

The latch assembly L also includes a transverse link 72 that at one end is extended into the clevised outer end of the latch leg (arm) **74*a* of the latch 74 and pivotally connected thereto by a transverse pivot 73 and at its opposite end is pivotally connected to the outer clevised end of the leg (arm) 75*a* of the latch 75 by a pivot 73. The link 72 is rigid whereby one transverse end can not pivot relative to the other. The outward movement of the latch assembly in the chamber 50 is limited by one of the link outer transverse edge and the maximum radial dimension of outer edges of the latch legs bearing against one of the shoulder 51** and the torus wall, the difference between the radial dimension and the axial spacing of the outer transverse edge of the link, advantageously being less than a quarter of an inch.

Figure 9:
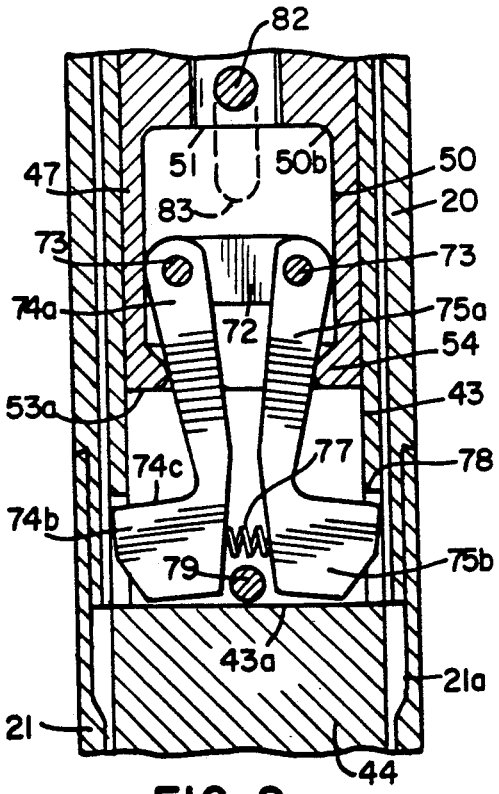
FIG. 9 is a view similar to that of FIG. 7 other than it illustrates the latches retracted and just prior to any significant outward movement of the drilling assembly in the drill string.
Figure 10:
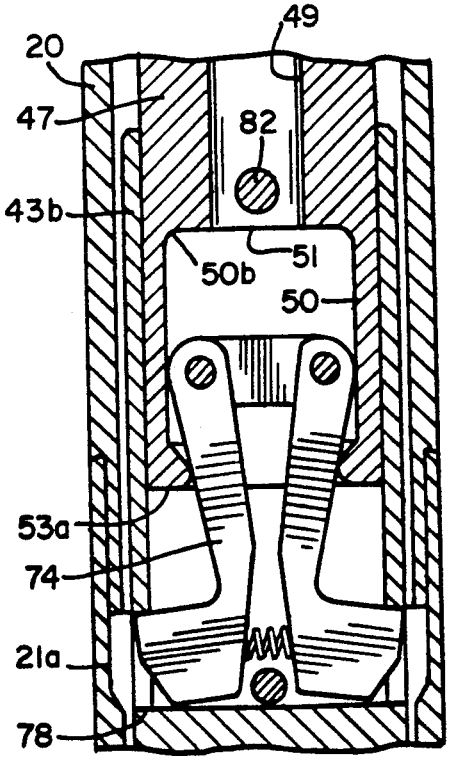
FIG. 10 is a view similar to that of FIG. 7 other than it illustrates the entire drilling assembly being moved outwardly with the latches in their retracted position.
Figure 13:
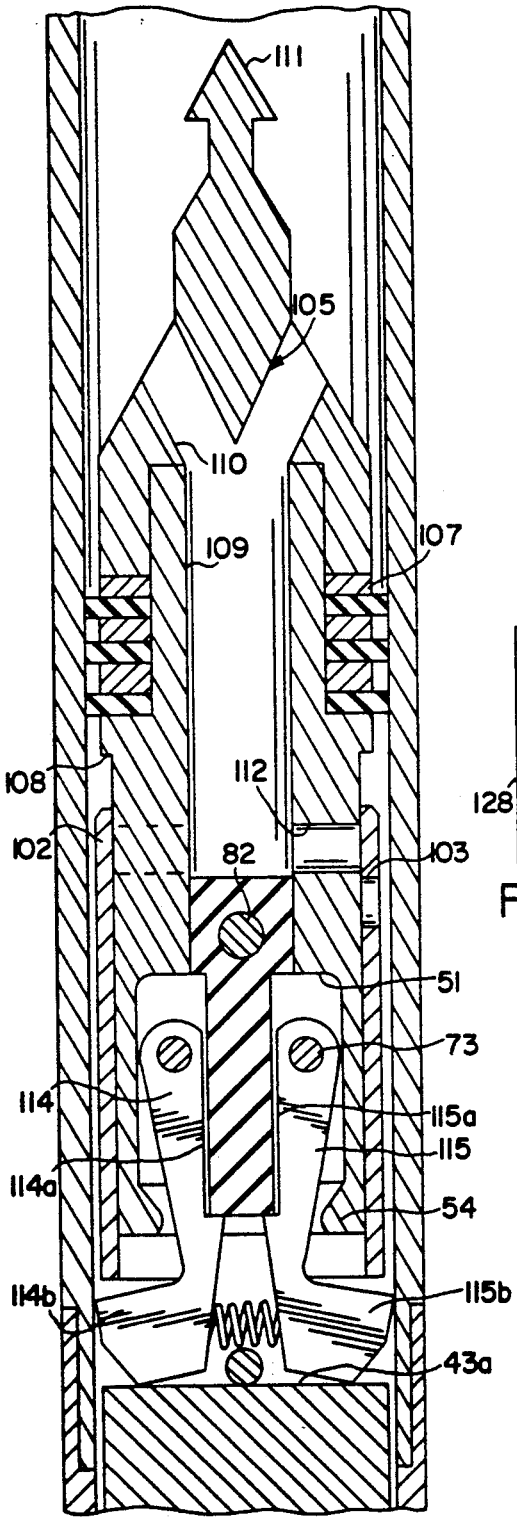
FIG. 13 is a longitudinal sectional view through the outer end portion of the fourth embodiment of the drilling apparatus of this invention as it is fluidly propelled axially inwardly.
Figure 15:
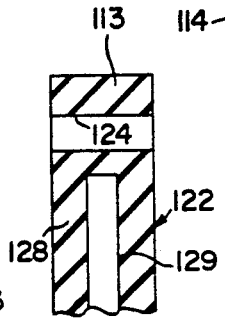
FIG. 15 is a fragmentary longitudinal cross sectional view of the underground pin that is generally taken along the line and in the direction of the arrows 15—15 of FIG. 16.
Figure 14:
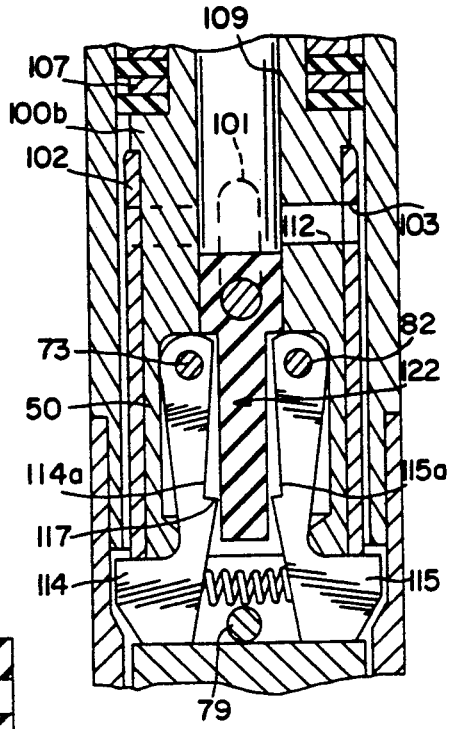
FIG. 14 is a fragmentary longitudinal section of a portion of the structure shown in FIG. 13 other than the drilling apparatus is in its latch seated position.
Figure 16:
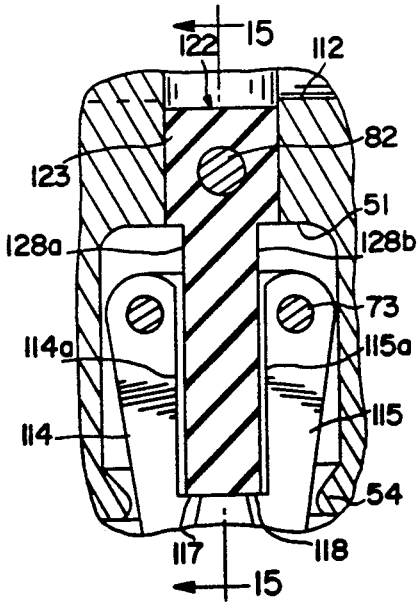
FIG. 16 is an enlarged fragmentary section of a portion of FIG. 13 showing the underground pin in a position for retaining the retractor in the retractor fluid bypass channel fluid flow blocking position as the fourth embodiment is being fluidly propelled axially inwardly.

Each of the latches includes a lateral section **74*b*, 75*b* (see FIG. 9) respectively joined to the inner end of the respective leg to extend laterally outwardly of the other latch lateral section and a substantial distance further radially outwardly than the respective leg to which it is joined. The lateral extensions in axial cross section in planes perpendicular to the radial directions that the lateral sections extend away from legs desirably are rectangular. The latch body tubular portion 43*b* has diametric opposite, rectangular slots 78 through which the lateral sections are extended to extend into latch recess 21*a* when the latches are in their latch seated position of FIG. 1. The latches are resiliently urged to move to their latch seated position by a coil spring 77 having opposite ends seated in wells in the lateral sections. A stop pin (member) 79 is mounted by the tubular portion 43*b* a short distance outwardly of the wall 43*a* to extend parallel to the pins 73 to limit the pivotal movement of each latch lateral extension toward the slot 78 through which the other lateral extension extends. The stop pin is axially inwardly of and transversely midway between the pins 73. Additionally, once the latch assembly and retractor is extended into the latch body tubular portion 43*b* to have the latch lateral sections extended into the tubular portion latch slots 78**, the stop pin prevents the latches being transversely retracted sufficiently to allow the latch assembly being moved axially outwardly of the latch slots.

In order to retract the latches from extending into the latch recess the flanges 54, 55 are provided. The minimum diametric spacing of the flanges is less than maximum transverse dimension of the link 72 as shown in FIG. 1, the flanges being abuttable against the transverse outer, axially extending surfaces **74*m*, 75*m* (see FIG. 8) of the latch legs adjacent to the juncture of the legs with the lateral sections for pivoting the lateral sections toward one another as the retractor is moved outwardly relative to the latch body. A transverse pin 82 is mounted by the retractor main body in fixed axial and transverse relationship positions relative thereto and extended into axial elongated, diametric opposite slots 83 in the latch body tubular portion to permit limited axial movement of retractor relative to the latch body and limit the outward movement of the retractor relative to the latch body. At the time the retractor shoulder 48*b* seats on the tubular portion 43*b*, the pin 82 either abuts against or is very closely adjacent to the axial inner end of the slots 83**.

Advantageously the axial length of the slots 83 is greater than the combined axial dimensions of the lateral extensions and the diameter of pin 82 such that the retractor edge **53*a* can be axially spaced from the outer transverse edge of the lateral sections by a distance greater than the axial dimension of a lateral section of a latch before there is any significant outward movement of the latch body. The center axes of the pivots 73 and the pins 79 and 82 are parallel relative to one another. The axial length of each of the pivots 73 and their radial spacing from the central axis C—C is such that the pivots 73 throughout their entire transverse dimensions are significantly spaced from the surface defining the chamber 50, for example by about at least the radius of a pin, and accordingly is further transversely spaced from the adjacent parts of the tubular portion 43***b*. As may be seen from FIGS. 1 and 4, the pivots are radially inwardly of the axial adjacent part of the latch body and radially opposite the axial adjacent part of the retractor from the latch body. Thus the pivots 73 are axially movable relative to each of the pins 79, 82 while the pivots 73 are axially movable relative to the pin 79. Thus the latch assembly is free floating in the chamber 50.

The latches are of the same construction, but are mounted in oppositely facing relationship. When, for example, the latches are in their latch seated positions, the inner and outer transverse surfaces of the lateral extensions are advantageously substantially parallel to the wall 43*a*. For example in the latch seated position, the latch 74 has its axially inner and outer transverse surfaces 74*c*, 74*d* respectively substantially parallel to the wall 43*a*. The pivot axes of the latches are located such that during the initial retraction pivotal movement of the latches, the portions of the lateral extensions outer transverse surfaces (edge 74*c* of latch 74) that abut against the lock coupling transverse latch recess edge 20*a* moves axially inwardly at least until the latches have move completely radially inwardly of the latch recess.

Figure 4:
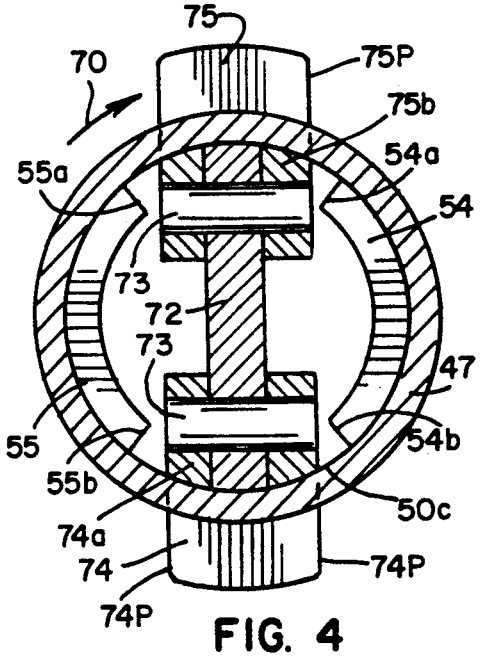
FIG. 4 is a transverse cross sectional view of the retractor and latch assembly generally taken along the line and in the direction of the arrows 4—4 of FIG. 1, other than the latch assembly is rotated 90° relative to that shown in FIGS. 1 and 3.
Figure 5:
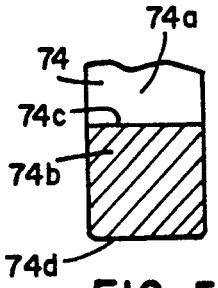
FIG. 5 is a fragmentary cross sectional view of the axial inner portion of a latch that is generally taken along the line and in the direction of the arrows 5—5 of FIG. 3.

As may be seen from FIGS. 3 and 4, the flanges 54, 55 having angularly opposite, radially extending flange ends 54*a*, 54*b* and 55*a* 55*b* respectively that extend radially outwardly to intersect with chamber surface 50*a* . The transverse angular dimension of each of the flanges is substantially greater than each of the angular spacing of the flange edges 54*a*, 55*a*, the flange edges 54*b*, 55*b* and the corresponding dimensions of the latch legs (see FIG. 4), for example 20° to 30° greater. Further as may be seen from FIG. 4, the maximum transverse width (direction of the axial dimension of a latch pivot) of each latch is somewhat less than the corresponding transverse dimension of the minimum spacing of, for example, flange edges 54*a*, 55*a*.

Advantageously the latch assembly L, the latch body B and the retractor 45 may be assembled by first grasping the latch assembly with the latch lateral sections adjacent to one another and the assembly rotated about 90 degrees relative to the retractor to a position such as indicated for the link 72 in FIG. 4. As may be apparent, the maximum transverse dimension of the link (when parallel to shoulder 51) is only slightly less than the diametric spacing of the surface portions 50*c*, but substantially greater than the minimum diametric spacing of the flanges. Further the width dimension of the link and the axial dimension of each of the pins need be only slightly less than the minimum spacing of, for example the edges 54*a*, 55*a*. Now the latch assembly is translated toward the shoulder 51 and after the link is moved outwardly of the annular flanges, the latch assembly is rotated in the direction of the arrow 70 and move axially outwardly relative to the retractor to the position shown in FIGS. 2 and 3 and the lateral sections allow to be spring urged apart to abut against the flanges. Thereafter the latch assembly retractor combination is inserted into the latch body tubular portion 43*b* until the shoulder 48*b* abuts thereagainst, the axially outwardly and oppositely radially tapered edges of the latch lateral sections facilitating such insertion. The insertion is such that the lateral latch sections are adjacent to the slots 83. Now the pin 82 is inserted through the slots 83 and the retractor, including rotating the retractor relative to the latch body if necessary to do so. Then the pin 79 is mounted to the latch body to extend between the latch lateral sections and the retractor is rotated about the central axis C—C relative to the latch body, if necessary, whereby the pin 79 can be mounted to the latch body and the lateral sections extended into the slots 78.

The latch lateral sections are shaped and of dimensions that the maximum movement of each of the sections toward the other is limited by abutting against the pin 79 whereby a portion of the respective section remains extended into the respective latch slot 78. Thus the dimensions of the lateral sections relative to the latch slots and/or the pin 82 and relative to the slots 83 prevents any significant rotation of the retractor relative to the latch body. Even if neither of the lateral sections extended into slots 78, or the pin 82 extended into slots 83 prevented any significant rotation of the retractor relative to the latch body, the pin 79 prevents sufficient rotation of the latches relative to the latch body about the central axis C—C to a position corresponding to that shown in FIG. 4 and the latch lateral sections to abut against the arcuate wall sections 50*c*. Usually the spring 77 acts to retain the latch lateral sections extending within the slots 78, even when the latches are in their latch retracted positions. If neither of the latches extended into the slots 78 and the pin 79 were removed, the latch assembly would be freely rotatable in the chamber 50 about the central axis C—C. Thus no part of the latch assembly is fixedly attached to either the retractor or the latch body, but rather the movement relative thereto is limited by sizes and shapes of latch body slots 78 and wall 43*a*, the retractor chamber 50, the flanges 54, 55, the pin 79 and the drill string when the latch body is extended therein. Further as will be in part explained with reference to the use of the apparatus described herein relative to the retraction of apparatus, the stop pin 79 prevents the latch assembly moving completely out of the retractor chamber 50.

Figure 11:
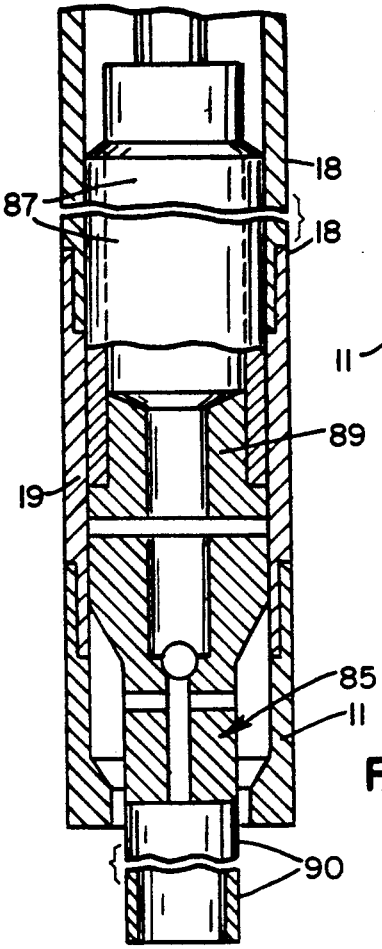
FIG. 11 is an axial cross sectional view of the inner end portion of a second embodiment of the invention with an axial intermediate portion being broken away, said view showing an earth sampler tube subassembly.

As may in part be seen from FIG. 11 the second embodiment of the drilling tool, instead of being a core receiving tube subassembly mounted to the latch body such as previously described, may be an earth sampler tube subassembly, generally designated 85. The second embodiment includes the latch body, the latch assembly and the retractor of FIGS. 1 and 3–6. However, instead of the spindle subassembly 41, there is provided a conventional earth sampler spindle 87 that at its outer end is threadedly connected to the inner end of the latch body W and at its inner end is threadedly connected to a sampler sub 89. The sub 89 threadedly mounts a soil sampler tube 90 to extend through and inwardly of the drill bit 11. The sampler tube may extend the desired distance inwardly of the drill bit. The spindle may or may not be of the type that permits the tube 90 rotating relative to the latch body.

Figure 12:
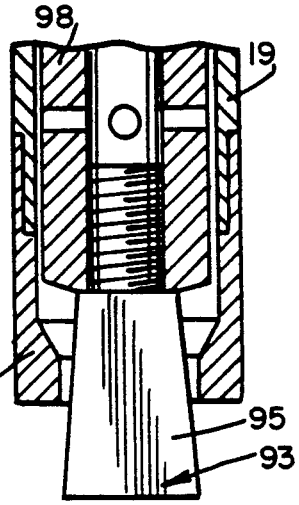
FIG. 12 is an axial cross sectional view of the inner end portion of a second embodiment of the invention with an axial intermediate portion being broken away, said view showing a drag bit.

As may in part be seen from FIG. 12 the third embodiment of the drilling tool instead of being a core receiving tube subassembly or an earth sampler subassembly such as previously described, it may be a drag bit subassembly, generally designated 93, such as in part shown in FIG. 12. The third embodiment differs from the second embodiment in that instead of sub 90 being connected to a spindle, for example one similar to spindle 87 with the possible exception it is of a type that the sub connected thereto is rotated thereby, a spindle to drag bit sub 98 is threaded connected to the spindle while sub 98 threadedly mounts a drag bit 99 to extend through the aperture of the drill bit and inwardly of the bit 11. Of course with an appropriate sub, a plug bit may be used instead of a drag bit.

Figure 7:
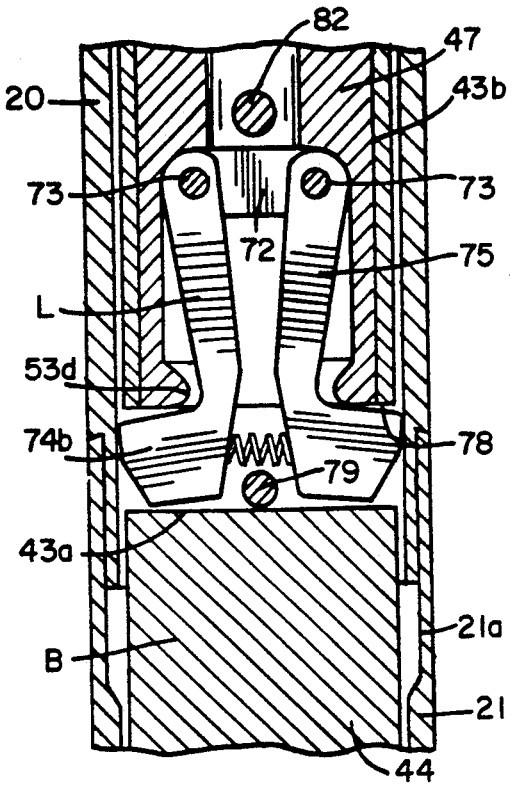
FIG. 7 is an axial cross sectional view of a portion of the first embodiment with the drilling assembly moving axial inward toward and adjacent to the drill string latch recess.

In using the apparatus of this invention, for example, the core barrel inner tube assembly 15 of the first embodiment, the assembly 15 is inserted into the outer end of the drill string and as the assembly moves inwardly, the transverse inner surface of the drill string limits the movement of the latches to their partially extended position such as shown in FIG. 7. Also, at this time the pin 82 is at or closely adjacent to the inner end of the slot 83, and thus the retractor does not presently limit the extending movement of the latches. As the latch body moves to seat on the landing ring, the latch lateral sections move nearly entirely radially to extend into the latch seat recess whereby in the latch seated position, the radial outward movement is limited by one or both of the latch legs abutting against the flanges and the lateral sections abutting against the adaptor coupling, see FIGS. 1 and 8.

During the core taking step, the downward drill force on the drill string is transmitted through the latch lateral section to force these sections to move downwardly relative the latch body and retractor (if necessary) to abut against the planar wall 43*a*. At this time the axially, transversely extending central axis D—D of each latch lateral extension is substantially perpendicular to the central axes C—C of the core barrel inner tube assembly and the drill string. Adjacent to the juncture of each latch leg to the respective latch lateral section, advantageously the radially outwardmost part of the leg is further transversely outwardly of the central axis C—C than the corresponding spacing of the respective latch pivot axis when the latch is in its latch seated position; while when the latch is in its retracted position its radially outwardmost part is transversely on the opposite side of said pivot axis. Additionally the transversely opposite ends of the link and the adjacent parts of latch legs are generally transversely arcuately curved about a radius that is nearly the same as that of the chamber 50 adjacent to the shoulder 51. Further, the transverse radius of curvature of radial outward surfaces 74*m*, 75*m* of the legs is such that the legs form a relatively close fit to the adjacent parts of the flanges against which they abut during use, and the transverse radius of curvature of the radial outward, axial outward portions of the lateral sections are of a radius curvature that is substantially the same as the inner radius curvature of axial parts of the latch seat 21*a*.

Usually, after a core jam or the core receiving tube has taken the desired axial length of core, the drill string is retracted a short distance as is conventional and a suitable wire line overshot assembly (not shown) is lowered or allowed to move axially inwardly to couple onto the coupling portion 48. If the flanges are not already in abutting relationship to the latch legs, the initial retraction of the wire line moves the retractor outwardly to exert a radial inward force on the latch legs adjacent their juncture with the lateral sections prior to the pin 82 moving any substantial distance away from the inner ends of the slots 83. At this time the radial force is applied to the legs closely adjacent to the maximum axial spacing of the point of contact of the flange with the leg from the respective pivot pin 73. This feature in combination with other features of the latch assembly and the retractor previously and below described, the maximum mechanical advantage is obtained for providing a radial retracting force to the latches while minimizing the axial outward force to the latch assembly relative to the radial force during the initial retraction of the retractor. Further, since the axial inwardmost, radial inwardmost corners 74*d*, 75*d* of the latches in their latch seated position (see FIG. 8) are advantageously a short distance radially outwardly of the vertical plane perpendicular to the wall 43*a* and containing the respective latch pivot axis in order that the initial pivotal movement of the inwardmost corners is slightly axially inward and primarily radially inwardly toward the central axis. Even if, in the latch seated position, the corners are slightly radially inwardly of the plane referred to in the preceding sentence, the initial radial movement of these corners is many times greater than the axial movement of said corners. In either event, the radial outward, axially outer corner portions 74*h*, 75*h* of the latches that are abuttable against the axial inner transverse edge 20*a* of the lock coupling 20 during the entire retracting movement latch corner portions 74*h*, 75*h* are primarily radially inwardly and secondarily axially inwardly. Also to be noted is that the radial outward axially elongated surfaces 74*m*, 75*m* of the latch legs against which the flanges are abuttable during use diverge from one another in an axial outward direction and are on diametric opposite sides of the latch body central axis C—C during movement of the latches between their retracted and latch seated positions. For example, the angle of taper of each surface 74*m*, 75*m* relative to the axis C—C may be about 5-15 degrees when the latches are in abutting relationship to the axial wall of the latch recess. Additionally the side surfaces 74*p* and 75*p* respectively of the latches on one transverse sides advantageously are contained in one axially extending plane that is perpendicular to the latch pivot axes and parallel to transversely opposite side surfaces 74*p* and 75*p* of the latches which are contained in a second axially extending plane that is parallel to the first plane. Thus the latches are of the same size and shape, but oppositely faced, and are not transversely offset from one another in the direction of the extension of the latch pivot axes.

With reference to the two planes referred to in the preceding paragraph, advantageously these planes are equally transversely spaced from a third plane containing the central axis C—C. The third plane is transversely intermediate the two planes and parallel thereto. As a result the transverse width of the latch lateral sections (direction of elongation parallel to the latch pivot axes) may be about twice that of conventional latches in transverse side by side relationship, for example such as disclosed in U.S. Pat. No. 3,103,981, and thus provide a much greater area of latches for bearing against the latch recess edge 20*a* to decrease wear of and/or damage to the lock coupling. That is larger area results in decreasing the deforming, cracking or breaking up of the inner end of the wear coupling.

Figure 8:
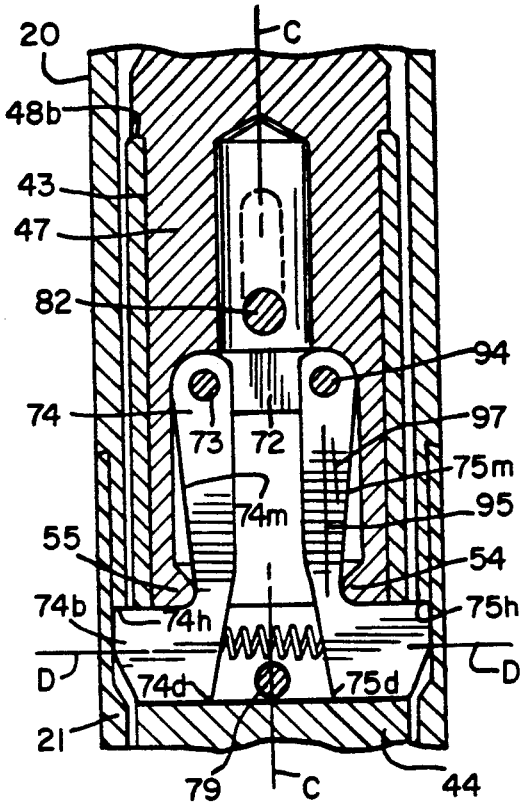
FIG. 8 is a view similar to that of FIG. 7 other than it illustrates the latches seated in the latch recess.

In referring to FIG. 8 the radial line 97 that emanates from the latch pivot axis 94 and passes through a point of contact of the flange 54 with the surface 75*m* of the latch 75 when the latch is seated and the retractor is initially withdrawn, advantageously extends at an angle of about 2.5 to 10 degrees relative to the radial line 95 that is parallel to the central axis C—C and emanates from the pivot axis 94 of the pivot 73 for the latch 75. Additionally, at this time, the radial distance of the point of contact to the pivot axis is about 10 to 15 times the minimum transverse distance of the point of contact to the radial line 95 as viewed in FIG. 8. As a result as the retractor is moved axially outwardly relative to the latches, the mechanical advantage acting to retract the latches decreases. Also, advantageously, when the latch is seated in the latch seated position, the point of contact is located further radially outwardly from the central axis than the line 95.

As the latches are retracted out of the latch seat, the retractor moves axially outwardly relative to the latch body and the latch assembly the mechanical advantage decreases to prevent excess force being used after retraction from the latch seat and resulting damage to the latch assembly. When the retractor has been moved sufficiently outwardly relative to the latch body, the pin 82 abuts against the outer ends of the slots 83 which results in the latch body and the structure depending therefrom being retracted without further outward movement of the retractor relative to the latch body. After the core barrel inner tube assembly has been fully retracted, the assembly is removed from the drill string.

In view of the description of the use of the first embodiment of the core barrel inner tube assembly, it is believed the use of the second and third embodiments is obvious from the description set forth herein.

The fourth embodiment of the invention, see FIGS. 13-16, the head assembly is the same as the first embodiment except for the differences set forth hereinafter. In the fourth embodiment the slots 101 in the latch body 102 may be of an axial length that is the same as that of the slots 83. Additionally the outer tubular portion of the latch body has fluid bypass ports 103 that form part of the axial outer bypass channel, generally designated 105 of the fourth embodiment.

The latch retractor, generally designated 100, has an outer portion 100*a* and an inner portion 100*b* removably connected to portion 100*a*. The inner portion has a reduced diameter tubular portion extended into a bore of the outer portion to provide axially spaced, radial outer transverse annular edges abutting against the annular seal subassembly 107 which has resilient members forming a fluid seal between the drill string and the latch retractor axially outwardly of the ports 103 and the latch seat 21*a*. The subassembly 107 includes metal washers in abutting relationship with the resilient members.

The inner portion of the retractor has an inwardly facing shoulder 108 inwardly of the seal assembly for abutting against the transverse outer annular edge of the latch body tubular portion. Further the retractor inner portion 100*b* has an axially extending central bore 109 that at its inner end opens through the annular shoulder 51 to the chamber 50 of the fourth embodiment, and at its outer end opens to the inner end of the outer portion of the inclined bores 110 that in turn open to the annular space between the latch retractor and the drill string adjacent to the retractor overshot spearpoint portion 111. The retractor inner portion also has transverse ports 112 that open through the radial outer surface of the retractor and to the bore 109, and additionally form a part of the bypass channel 105.

The latches 114, 115 of the fourth embodiment are the same as the latches 74, 75 other than the latches 114, 115 have generally tubular section, radially inner cutouts 114*a*, 115*a* respectively to provide transversely arcuately curved, axially outwardly facing shoulders 117, 118. The shoulders are axially intermediate the latch lateral sections 114*b*, 115*b* and the latch pivot pins 73.

A resilient underground pin (seal member), generally designated 122, has an axial outer cylindrical portion 123 to form a fluid seal with the cylindrical wall that in part defines bore 109 axially intermediate the ports 112 and the transverse annular wall 51. The cylindrical portion is mounted by the transverse pin 82 which extends through the cylindrical portion to retain the seal member in fixed axial relationship relative to retractor.

The seal member has transversely spaced legs 128 that are transversely spaced to form a downwardly opening slot for having the latch link 72 extended therethrough, the legs being dependingly joined to the cylindrical portion. The slot 129 permits the seal member being moved axially relative to the link. The legs have arcuately curved, transversely outer cutouts to provide transversely opposite outer peripheral wall portions of a radius curvature that is slightly less than the transverse inner latch surfaces 114*a*, 115*a* such that the legs are seatable on the shoulders 117, 118, FIG. 13, when the fourth embodiment is being fluidly propelled axially inwardly, but once the latches have moved to their latch seated positions, move axially inwardly of the shoulders to the position of FIG. 14. The maximum diametric dimension of the transverse outer peripheral surfaces of the legs arcuately between the latches may be the same as the diameter of the cylindrical portion 123.

The legs are of an axial length that with the latches 114, 115 abutting against the latch body wall 43*a*, and the seal member abutting against the shoulders 117, 118, during the time the fourth embodiment is being fluidly propelled inwardly, the ports 112 are axially outwardly of the ports 103 and accordingly the fluid bypass channel 105 is blocked to prevent fluid flow from axially outwardly of the seal subassembly 107 to be inwardly of the subassembly. When the latch body seats on the landing ring and the latches have moved to their latch seated position, the fluid pressure on the fourth embodiment moves the retractor and seal member inwardly relative to the latch assembly and the latch body to the FIG. 14 position whereby the ports 112 open to the ports 103 to permit fluid flowing from outwardly of the spearpoint portion 111, through the bypass channel 105 and then to the annular space between the latch body and the drill string that is axially inwardly of the seal subassembly. The latch body slots 101 are of an axial length to permit such movement of the retractor, the pin 82 and the seal member relative to the latch body.

Although not necessary, advantageously the slots 101 and other parts of the tubular portion of the latch body and the inner portion of the retractor may be of axial dimensions to not only permit the movement of the retractor relative to the latch body such as set forth in the preceding paragraph, but also the slots advantageously are of axial lengths to permit the retractor, the seal member and pin 82 to move axially outwardly relative to the latch body to a position that the ports 112 open radially outwardly relative to latch body axially outwardly of the latch body tubular portion outer terminal edge. In such in event the fluid may flow through the channel 105 as the fourth embodiment is retracted and accordingly the fourth embodiment does not pull fluid outwardly through the drill string such as would occur if the slots were of lengths to permit only relative movement between the axial positions shown in FIGS. 13 and 14.

The resilient stop member 122 is of sufficient rigidity to function as heretofore described. Even though the stop member 122 has been described as being resilient, it can be made of a rigid material as long as it functions as herein described. Further, the stop member can be formed as an integral unitary part of the retractor, however, it would require different machining operations in order to form the fluid bypass channel.

As a result of providing the seal subassembly 107 and the seal member 122 seatable on the latch shoulders 117, 118, the fourth embodiment is fluidly propellable inwardly through the drill string regardless of the direction of extension (underground) of the bore hole. Further the retractor of the fourth embodiment is axially movable relative to the latch assembly such as described with reference to the first embodiment.

The latches of any one of the first three embodiments may have notches or cut-outs 114*a*, 115*a* such as described with reference to the fourth embodiment. Also the second and third embodiments may be modified to incorporate the seal subassembly 107, latches 114, 115 and seal member 122 of the fourth embodiment in the event the second or third embodiments are to be used for underground drilling as contrasted to drilling wherein the drilling apparatus may free fall to the bit end of the drill string.

Figure 17:
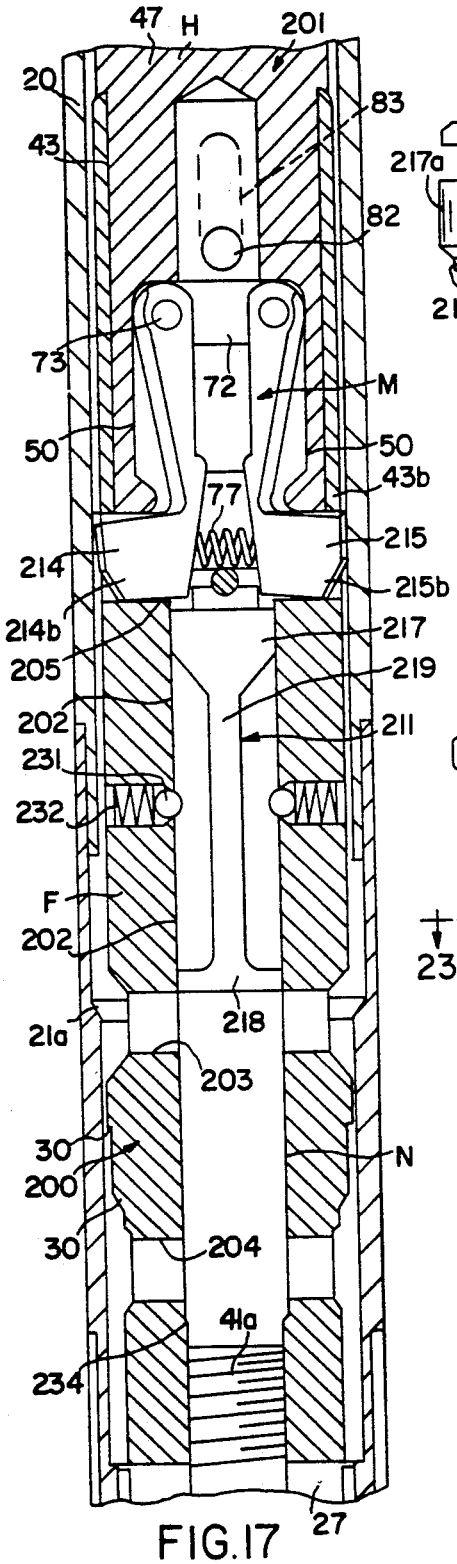
FIG. 17 is a fragmentary, longitudinal sectional view of the fifth embodiment of the core barrel inner tube assembly as it moves axially inwardly, but is axially outwardly of the latch seat, and the fluid bypass channel is open, various details of the valving mechanism not being shown.
Figure 18:
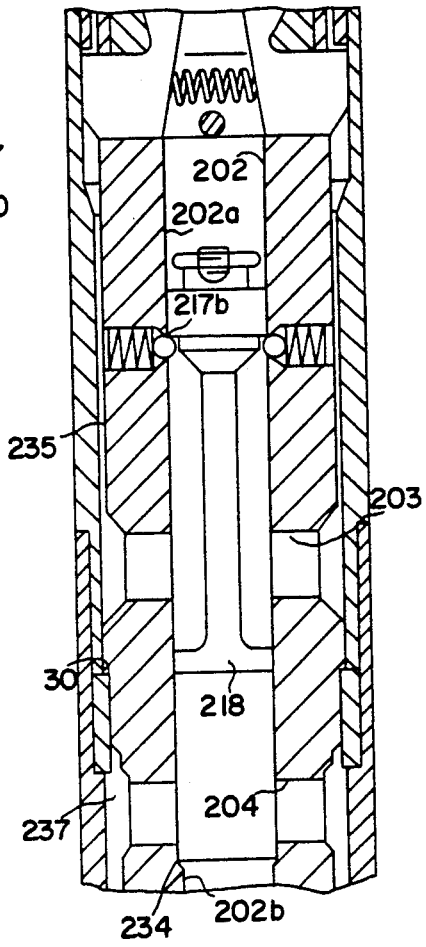
FIG. 18 is a view of the structure of FIG. 17 other than for showing the inner tube assembly in its latch seated position and the valving mechanism after it has been released by the latches and moved axially for being releasably retained in a position blocking the fluid bypass channel while seated on the detent balls.
Figure 21:
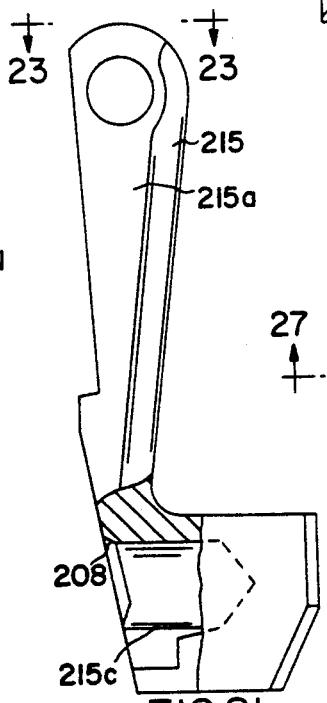
FIG. 21 is a side view of one of the latches of the fifth embodiment with a portion shown in cross section.
Figure 19:
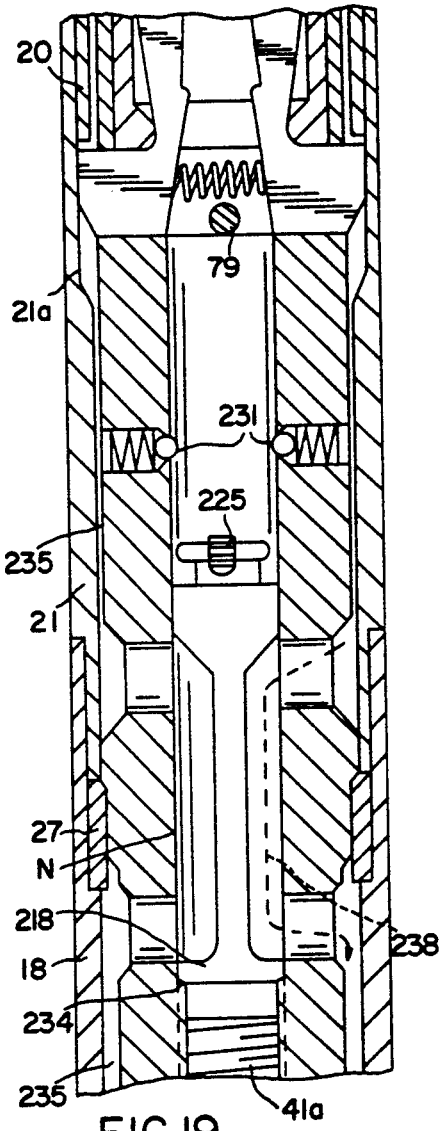
FIG. 19 is a view of the structure of FIG. 18 other than for showing the inner tube assembly in its latch seated position and the valving mechanism after it has moved axially inwardly of its FIG. 18 position to its landing seated, latch seated position to fully open the fluid bypass channel.

Referring in particular to FIGS. 17–19, the core barrel inner tube assembly, generally designated 200, of the fifth embodiment has a head assembly H that includes a retractor 201, a latch body W, a plunger 211, and a latch assembly M, each being generally designated. The head assembly of the fifth embodiment may have a spindle assembly mounting a core assembly receiving tube, such as referred to with reference to the first embodiment or the drill tools of either of the second and third embodiments. The latch body W mounts the retractor 201 for limited axial movement in the elongated body chamber 43 which opens through the outer end of the latch body, there being a pin 82 extended through slots B3 in the latch body. The retractor 201 is the same as that of the first embodiment and is mounted to the latch body in the same manner. The inner end of the latch body chamber 43 opens to the axially elongated bore 202 that in turn opens through the inner end of the latch body and forms part of the fluid pass channel N. The opening of bore 202 to the body chamber forms a radially inner generally transverse, planar annular shoulder 205. The spindle bolt 41*a* of the spindle subassembly 41 is threaded into the inner end of the bore 202.

The latch body also includes outer transverse ports 203 that open to bore 202 axially outwardly of the landing shoulder 30 and inner transverse ports 204 that open to bore 202 axially inwardly of the latch body landing shoulder 30, ports 203, 204 and the part of bore 202 axially between the opening of the ports 203, 204 opening to the bore 202 forming the fluid bypass channel N. The axial length of the landing ring 27 is less than the axial spacing of the ports 203, 204 through the radial outer peripheral surface of the latch body.

Figure 20:
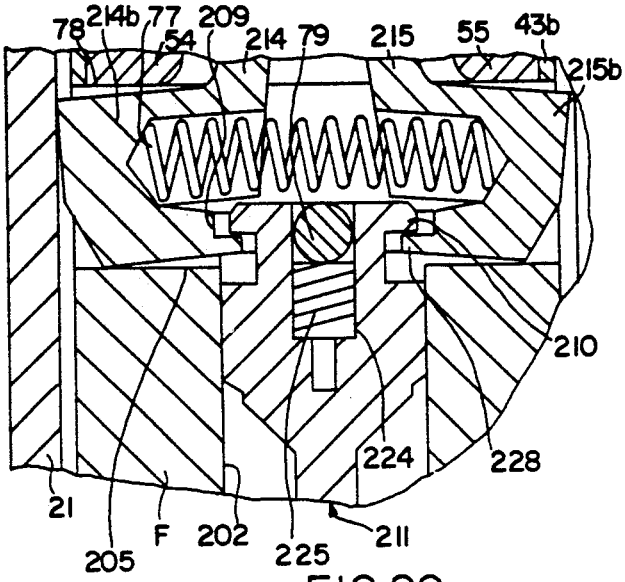
FIG. 20 is an enlarged fragmentary view of a portion of the structure of FIG. 17 to show the coupling engagement of the valving, mechanism by the latches.
Figure 24:
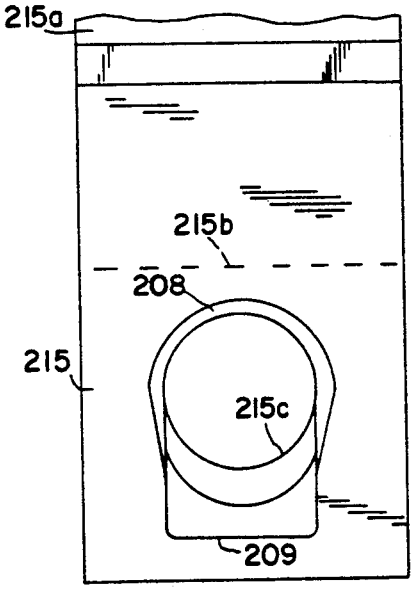
FIG. 24 is a fragmentary, enlarged axial view of the inner end portion of the latch that is generally taken along the line and in the direction of the arrows 24—24 of FIG. 23.
Figure 22:
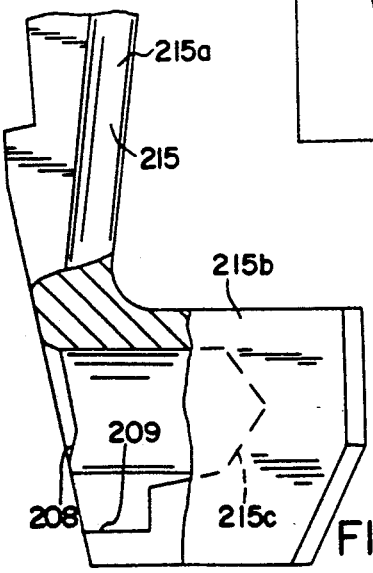
FIG. 22 is an enlarged side view of a portion of the latch of FIG. 21 with the cross sectional part being generally taken along the line and in the direction of the arrows 22—22 of FIG. 23.
Figure 23:
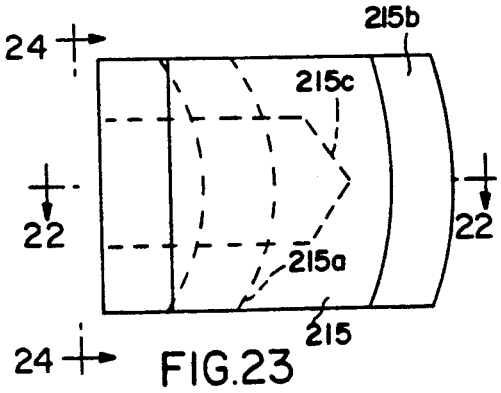
FIG. 23 is a bottom view of the latch of FIG. 21.

The retractor 201 has a latch assembly chamber 50, which advantageously is the same as that of the first embodiment, has latch assembly M extending therein that advantageously is of the same shape and size as the latch assembly of the fourth embodiment except for the differences set forth below. The latch assembly M includes transverse pivots 73, a rigid transverse link 72 that mounts the pivots at its transverse opposite ends and latches 214, 215 that have outer ends mounted to the respective pivot and a spring mounting apertures 214*c*, 215*c* in latch lateral portions 214*b*, 215*b* respectively for having the adjacent end of the spring 77 mounted therein (see FIG. 20) for resiliently urging the lateral portions toward their latch seated position. The latches have legs 214*a*, 215*a* respectively extending outward of the lateral portions. The radial inner portions of the apertures 214*c*, 215*c* each has a frustoconical portion 208 opening toward the other with the major base being radially inwardly of the rest of the aperture (also see FIG. 24). Additionally, each latch lateral portion has a plunger (valving mechanism) tang receiving recess 209 that opens outwardly to aperture 214*c*, 215*c* respectively for receiving the diametric opposite tangs (valve mechanism head) 210 of the valve mechanism (plunger), generally designated 211, as will be set forth hereinafter.

Figure 25:
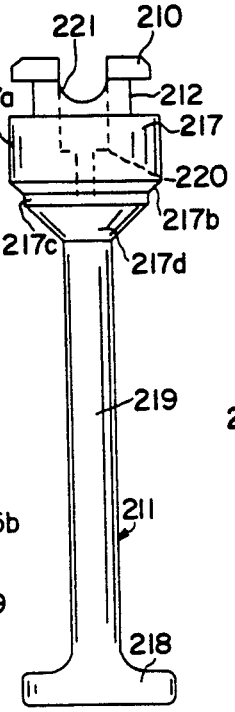
FIG. 25 is a side view of the valving mechanism (plunger) that is generally taken along the line and in the direction of the arrows 25—25 of FIG. 26.
Figure 26:
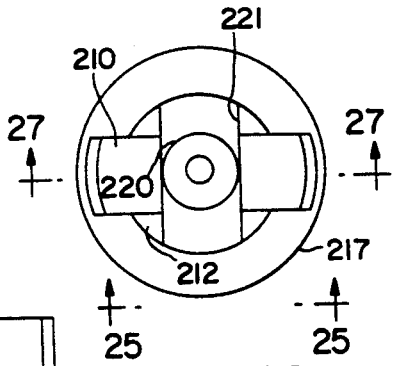
FIG. 26 is a plan view of the structure of FIG. 25.
Figures 27, 28, 29, 30, 31:
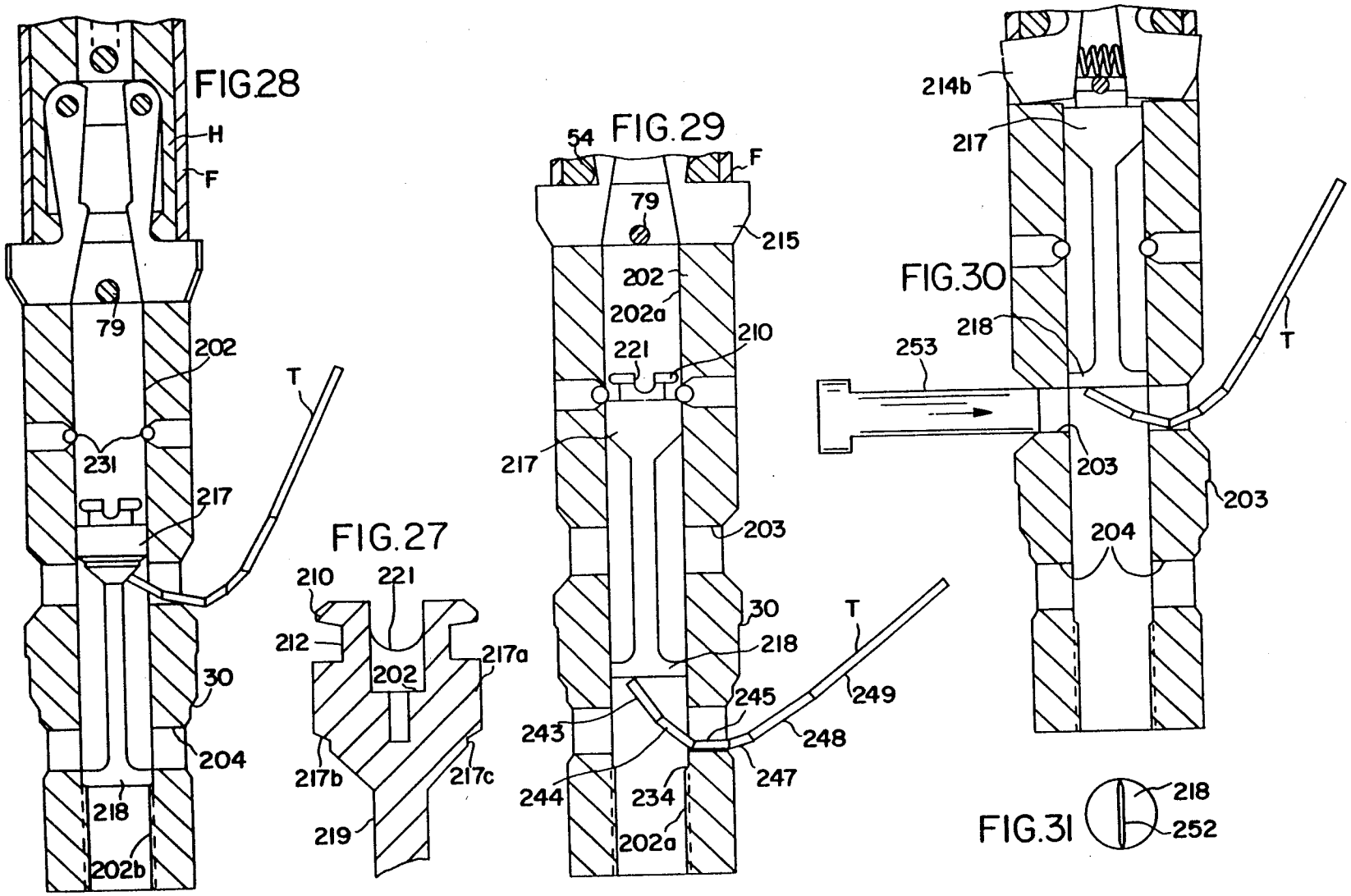
FIG. 27 is a fragmentary axial cross sectional view of the axially outer portion of the valving mechanism that is generally taken along the line and in the direction of the arrows 27—27 of FIG. 26.
FIGS. 28-30 are fragmentary, somewhat diagramatic axial cross sectional views of the fifth embodiment illustrating steps in loading the valving mechanism for being claspingly engaged by the inner tube assembly latch assembly.
FIG. 31 shows the axial inner end of the valving mechanism of FIG. 25.

Referring in particular to FIGS. 25–27, the valving mechanism has the plunger head (tangs) 210 joined to the outer end of the reduced diameter neck 212 which in turned is joined to the main cylinder body portion 217*a* of the outer piston 217. The outer piston is of a diameter to form a close fluid fit with the transverse inner peripheral wall defining the axial bore 202. The outer piston also includes a frustoconical portion 217*b* having a major base joined to portion 217*a* and a minor base joined to an axial short diametric portion 217*c*. The diametric portion 217*c* is joined to the major base of the inner frustoconical portion 217*d*, the minor base of which is joined to the outer end of the axially elongated valve, reduced diameter (plunger) stem 219. The inner end of the valve stem is joined to the generally cylindrical inner piston portion 218 that is of a diameter to form a close fluid fit with the peripheral wall defining the axial bore 202. The axial spacing of the inner and outer pistons is greater than the minimum axial spacing of the opening of the ports 203 and 204 to the axial bore 202 (see FIG. 19).

The valving mechanism (plunger) 211 has a transverse, generally U-shaped outwardly opening slot 221 formed in the head 210 and the neck (reduced diameter cylindrical portion) 212 and is of a size to receive the stop pin 79 therein for abutting against the neck to limit the outward movement of the plunger in the axial bore 202 relative to the latch body. A transversely centered, axial well 224 is provided in the axial outer end portion of the plunger to open axially outwardly through the slot 221. A coil spring 225 is mounted in the well 224 to in its relaxed condition extend slightly axially outwardly of the outer transverse surface of the tangs 210 and when the stop pin extends within the stop pin slot to abut against the plunger to limit the outward movement of the plunger, the spring 225 is compressed for resiliently urging the plunger to move axially inwardly of the annular shoulder 205.

Each lateral portion tang receiving recess 209 is located axially outwardly of the latch inner transverse surface and adjacent to the its radial inner, axial inner corner portion to have the adjacent tang 210 extend thereinto when the valving mechanism is in its axial outer position relative to the latch body and the latches are pivoted from their latch seated to their latch retracted position. The tang and latch recesses are of transverse dimensions that the latch lateral portions can move a limited amount transversely more closely adjacent one another than that shown in FIG. 20. The latch tang receiving recess 209 and the tang on each transverse side of the inner tube assembly central axis (head assembly central axis) are of sizes that when the respective tang extends into the recess 209 (valving mechanism latch coupled position), the valving mechanism can not move axially inwardly of the latches until both of the latches have pivoted to a seated position for engaging the adjacent latch seat. Thus when either one or both of the latches are in coupling engagement with the valving mechanism, a latch portion 228 extends axially between the adjacent tang and diametric portion 212 to engage the inner surface of the respective tang.

The latch body mounts a plurality of spring ball detents 231, 232 axially intermediate the bypass channel ports 203 and the annular shoulder 205 to have the detent balls 231 extend radially into the bore 202 and resiliently retained in such a position by a springs 232. The spring ball detents are located to be axially intermediate the valving mechanism outer and lower pistons when the tangs couplingly engage the valving mechanism head 210 and the inner tube assembly is in the drill string and moving axially toward a latch seated position. Further, at this time the axial inner piston 218 is located axially outwardly of the outer ports 203 so as not to block the fluid bypass channel and thereby restrict the rate of descent of the head assembly in the drill string. The outer piston portions 217*b*, 217*c* provide a shoulder seatable on the detent balls when the balls are in their radial inward position and when seated thereon, the inner piston is located axially intermediate the outer and inner ports (valving mechanism fluid flow blocking position).

The valving mechanism is movable to an axial inner, full bypass fluid flow position seatable on the latch body plunger shoulder 232 that is axially intermediate the spindle bolt 41*a* and the inner port 204 (see FIG. 19). The bore 202 has an outer bore portion 202*a* that is of a substantially constant diameter axially from the annular shoulder 205 to the axial inner bore portion 202*b* that is of a reduced diameter to form the plunger shoulder 234 at their opening to one another. When the valving mechanism is seated on the plunger shoulder, the valving mechanism inner piston 218 is inwardly of the inner ports 204 and the outer ports are inwardly of the valving mechanism cylindrical portion 217*a* and portion 217*b*. When the latch body is seated on the landing ring and the valving mechanism is seated on the plunger shoulder, a fluid flow path 238 is provided through the inner tube assembly from the annular clearance space 235 between the drill string (outer tube assembly) and the inner tube assembly that extends axially outwardly Of the landing ring to the annular clearance space 235 radially between the drill string (outer tube assembly) and the inner tube assembly that extends axially inwardly of the landing ring.

With the latches couplingly engaging the valving mechanism head and the retractor being held in its axial outer position relative to the latch body by hand or a conventional overshot assembly (not shown) with outward movement of the retractor outwardly relative to the latch body being limited by the stop pin abutting against the valving mechanism, the head assembly is lowered into the drilling surface (outer) end of the drill string (not shown). When the latches have moved into the drill string the retractor may be released and even if the retractor moves axially inwardly relative to the latch body, the latches in abutting against the inner peripheral wall of the drill string prevent the latches pivoting sufficiently toward their latch release position to allow the valving mechanism being uncouplingly engaged from the latches. Now the head assembly is allowed to free fall in the drill string, or drilling fluid can be pumped into the drill string to speed the axial inward movement of the head assembly or the head assembly can be lowered with the overshot assembly coupled thereto. The inner tube assembly can travel even through upset drill rods without the plunger being uncoupled from the latches because the latches will not release (uncouple from) the valving mechanism even though the latches pivot a limited amount about their respective pivot until both latches pivot to their fully latch seated position at the time the latch body shoulder seats on the landing ring.

The inward movement of the inner tube assembly stops when the latch body shoulder 30 seats on the landing ring 27. At this time the fluid bypass channel N is open and the latches are resiliently urged to move to their fully latch seated position and upon both of the latches moving to their latch seated position, the valving mechanism is released to fall inward, the initial inward movement of the valving mechanism being assisted by the spring 225 abutting against the stop pin 79. The latch released valving mechanism continues its axial inward movement until the shoulder 217*b* abuts against the detents balls 231. While abutting against the detent balls, the lower piston head blocks or substantially restricts fluid flow through the bypass channel from the ports 203 to ports 204 since the inner piston is axially intermediate the inner and outer ports, and as a result the fluid pressure builds up in the drill string to a preselected value to overcome the spring tension in the spring ball detents. Upon overcoming the spring tension, the valving mechanism move axially inwardly until it seats on the shoulder 234 and the fluid pressure in the drill string drops back down, indicating the head assembly is in a a positive drill stem shoulder landed and latched seat condiion. The pressure build up provides a high pressure signal at the surface. A conventional maximum pressure level gauge (not shown) can be used if the driller does not want to constantly watch the gage to ascertain when the inner core barrel inner tube assembly is latched to the outer tube assembly while seated on the landing ring (outer barrel seat for the inner tube assembly) and ready for proceeding with core sampling operations. Further, as a result of the provision of the high pressure signal and then the pressure dropping by the use of the fifth embodiment head assembly, the driller can save large amounts of time since, from the above substantial increase and then substantial drop of pressure, the driller knows the head assembly is seated on the landing ring and both of the latches are seated in the latch seat so that drilling can be resumed immediately, instead of timing the descent and adding additional time for a safety margin.

The fifth embodiment of the inner tube assembly is withdrawn in the same manner as the first embodiment is withdrawn from the drill string, the valving mechanism remaining seated on the plunger shoulder and not impeding fluid flow through the bypass channel during the withdrawal operation. Since the valving mechanism remains on the plunger shoulder, the valving mechanism does not prevent the latch lateral portions pivoting sufficiently closely adjacent to one another that the pin 82 can move outwardly in the slot 83 such as shown in the FIG. 9 position for the first embodiment. During the withdrawal the inner ends of the latches can move more transversely closely adjacent to one another and to the stop pin (latch retracted, withdrawing position similar to that shown in FIG. 9) with the arcuate flanges abutting against the flanges 54, 55 than when the latches are in coupling engagment with the valving mechanism (latch retracted, coupling engaging position see FIGS. 17 and 20) since the diametric portion 212 limits the movement of the latch lateral portions toward one another to be further transversely spaced than when the valving mechanism does not extend therebetween. The radial outward movement of the latch lateral section is limited by abutting against the drill string inner peripheral wall outwardly of the latch seat such that the transverse outer axial walls defining the latch recesses are transversely spaced from the diametric portion 212 with a portion of at least one latch extending between the axially adjacent tang and diametric portion 217.

After the withdrawal operation and advantageously with the latch body extending horizontal or nearly horizontal and the latches extending in their latch seated position relative to the latch body, the head assembly H is loaded (valving mechanism moved for being couplingly engaged by the latches) by moving the leg 243 of a special prybar type setting tool T through one of the outer ports 203 into abutting relationship with the inner surface of the outer piston. The tool T has a second leg 244 that at one end is joined to leg 243 and at the other end to a third leg 245 while a fourth leg 247 at its opposite ends is joined to the leg 245 and leg 248 respectively (see FIG. 29). An elongated lever arm 249 is joined to the end of leg 248 opposite the leg 247. The legs extend at progressively increasing angles from the leg 243 toward the elongated lever arm whereby the terminal leg 243 extends at about a right angle relative to the lever arm. The juncture of each leg to another in effect provides a pivot point abuttable against the inner wall surface of the ports 203 and 204 respectively.

The tool is inserted through one of the outer ports and has leg 244 or adjacent legs moved, which may include pivoting, in abutting relationship to the wall defining the respective one of the outer ports 203 with leg 243 abutting against the inner surface of the outer piston lo move the valving mechanism outwardly relative to the latch body until the inner transverse surface of the inner piston is moved axially outwardly of at least the innermost part of the ports 204. Then the tool is extended through one of the inner ports to have its terminal leg 243 abut against the inner transverse surface of the inner piston and moved, including pivoting on the inner surface part of the wall defining port 204 to move the valving mechanism further axially outwardly, including the cylindrical portion 217*a* outwardly of the detent balls. Thence the tool is extended through one of the outer ports and used to move the valving mechanism still further outwardly, the mark 252 on the inner transverse surface of the inner piston (see FIG. 31) indicating when the valving mechanism has been rotated about the inner tube central axis C—C to be aligned with the stop pin transverse central axis if not already in such a position.

Transverse opposite ends of the stop pin are visible at the exterior surface of the latch body while the mark 252 is visible when outwardly adjacent the transverse ports 203, 204 respectively. The valving mechanism may be rotated by extending a finger into one of the ports 203, 204 when the valving mechanism is located adjacent to the respective port. Now with the mark in substantial parallel alignment with the central axis of the stop pin, the tool is moved, including pivoting on the inner surface part of the wall defining port 204, to move the valving mechanism further axially outwardly, is used to push the valving mechanism against the resilient action of spring 225 abutting against the stop pin 79. While the tool retains the valving mechanism with the stop pin abutting against the inner surface of the slot 221, a plug 253 is pushed through one of the ports 203 to extend into the bore for blocking inward movement of the valving mechanism, thence the tool withdrawn from the outer port that it extends into and then the plug is pushed to extend into the port diametrically opposite the first port that it was pushed into. With the inward movement of the valving mechanism being blocked by abutting against the plug, the valving mechanism is retained in a position for the tangs extending into the latch recesses upon retracting the retractor to pivot the latches away from their latch seated position relative to the latch body. The head assembly is now loaded and ready for use, the spring 77 retaining the latch legs in abutting relationship flanges 54, 55 and the latch lateral sections extending radially outwardly through the latch slots if not restrained and the retractor is in its inner position relative to the latch body.

Before the loaded head assembly is used again the retractor is moved axially outward relative to the latch body by hand or an overshot body to retract the latches from their latch seated position whereby the tangs extend into the latch recesses to couplingly engage the valving mechanism, and then the plug is removed from the latch body prior to the inner tube assembly being extended into the drill string sufficiently to have the ports 203 located in the outer end of the drill string. The retractor is retained in an axial outer position relative to the latch body until the latch lateral portions are extended within the drill string to prevent the latches moving sufficiently toward their latch seated position to allow the valving mechanism moving inwardly relative to the shoulder 205.

Any one of the first, fourth and fifth embodiments of this invention and the sixth embodiment described below can be used in place of head assemblies (latch body, latch mechanism, and latch retractor mechanism including overshot coupling member) of various prior art head assemblies.

Referring now to FIGS. 32-35, the sixth embodiment of the invention, generally designated 300, is the same as the fifth embodiment, other than the latch body axially inwardly of the latches and the resilient mechanism for releasably retaining the valving mechanism 211 in a position to block inward fluid flow through the fluid bypass channel N. That is, the planar annular shoulder 301 of the latch body X of the sixth embodiment is the same as the shoulder 205 of the fifth embodiment as is the latch body X axially outwardly of the shoulder 301. The latch body X is made of at least two parts and includes an axial inner part 303 having an axial outer reduced outer diameter portion 303*b* threadedly extended into enlarged internal diameter bore portion 302*b* of the intermediate latch body portion 302 which extends axially inwardly of the shoulder 301. The bore portion 302*b* and diametric portion 303*b* are located axially intermediate the shoulder 301 and the axial outer ports 203 of the fluid bypass channel N.

Figure 32:
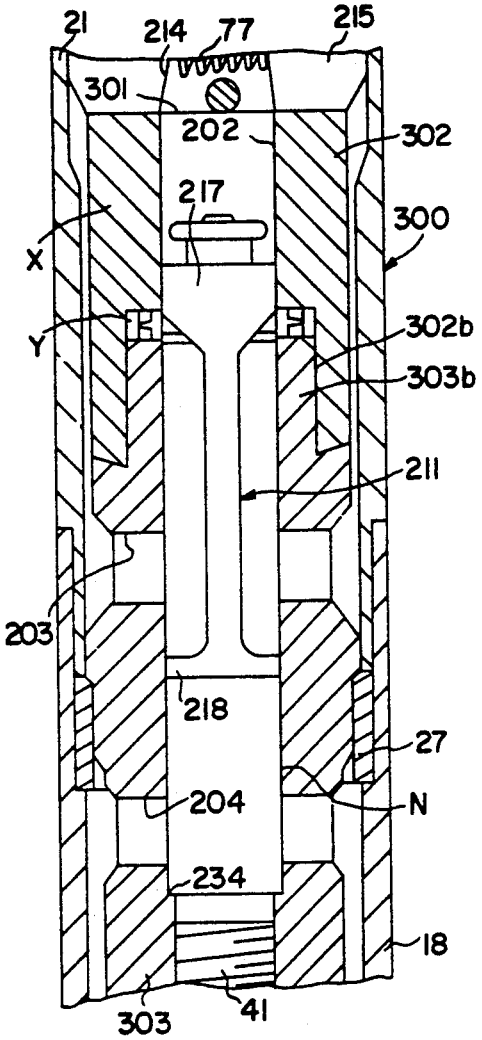
FIG. 32 is a view similar to FIG. 18, other than it is of the sixth embodiment.
Figure 34:
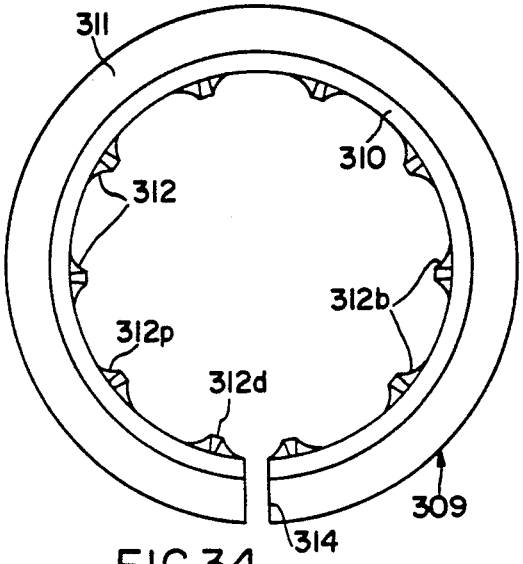
FIG. 34 is a plan view of the resilient ring of the sixth embodiment.
Figure 35:
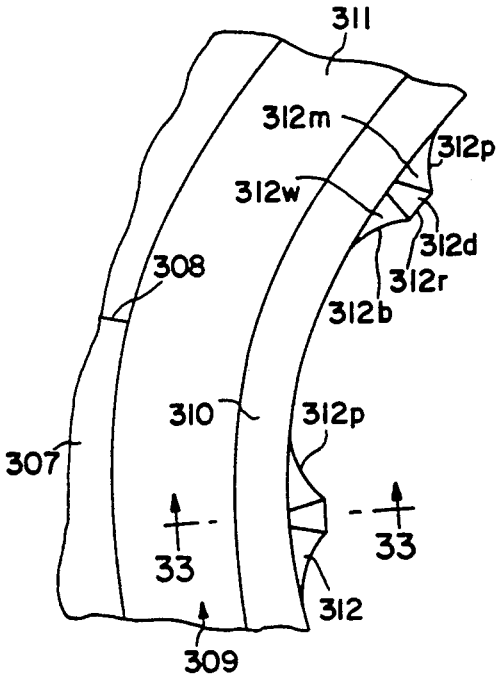
FIG. 35 is an enlarged fragmentary view of the ring of FIG. 34 and a portion of the rubber backing.
Figure 33:
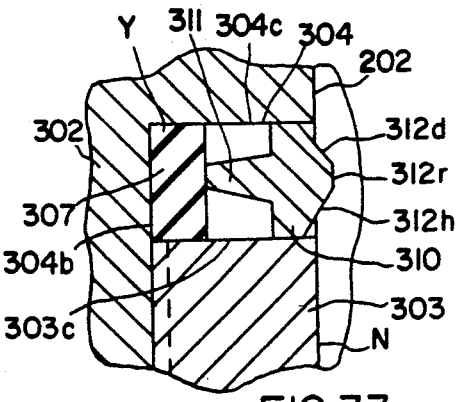
FIG. 33 is an enlarged fragmentary cross sectional view of the resilient mechanism of the sixth embodiment for resiliently retaining the plunger in the position for blocking axial inward fluid flow through the fluid bypass channel, said view being generally taken along the line and in the direction of the arrows 33—33 of FIG. 35.

The intersection of the part of the bore 202 of the intermediate latch body part with bore portion 302*b* forms a transverse, axially inwardly facing shoulder 304*c* that defines the axial outer transverse edge of a resilient mechanism chamber 304 which opens radially inwardly to the latch body bore 202. The chamber 304 is annular, the remainder of the chamber being defined by the axial outer, transverse annular edge 303*c* of the latch body portion 303*b* and the inner peripheral wall portion 304*b* that in part defines bore portion 302*b*. The relative axial lengths of the bore portion 302*b* and latch body portion 303*b* are such to maintain the transverse outer edge of portion 303*b* axially spaced from the shoulder 304*b* when parts 302, 303 are fully threaded together as shown in FIGS. 32, 33.

Instead of using spring urged detent balls (resilient mechanism) of the fifth embodiment for releasably retaining the valving mechanism 211 in a fluid bypass channel blocking position, the resilient mechanism Y of the sixth embodiment includes an annular backing member (rubber backing) 307 having its radial outer surface in fluid sealing relationship with surface 304*b*, and opposite transverse surface in fluid sealing relationship with shoulder 304*c* and the axial outer transverse surface 303*c* of latch body part 303. Also mounted in chamber 304 is an axially split, pressure indicating spring ring (preferably made of spring steel), generally designated 30.

The indicating ring 309 includes an annular main body 310 that in an axial plane of a radius of curvature of the ring is of a generally rectangular shape and has axial outer and inner transverse edges closely adjacent to the transverse edges of the chamber. The ring 309 also includes a transverse outer annular rib 311 that advantageously is trapezoidal in cross section along a radial, axial extending plane of the ring. That is, the outer rib has a major base joined to the radial outer surface of the main body and extends radially outwardly thereof to have its annular minor base abutting against or closely adjacent to the radial inner surface of the resilient backing when the ring is in its relaxed (datum) condition. Advantageously the rib is of a much greater radial dimension than the main body and is axially centered relative to the main body.

A plurality of circumferentially spaced, radially inwardly extending scallops (protrusions) 312 are integrally joined to the transverse inner surface of the main body 310 to extend radially inwardly thereof. Each of the scallops may be of the same size and shape. Before forming the scallops the ring may have a transverse inner annular rib that in axial cross section along a radial line of the ring is of a trapezoidal cross section with its major base joined to the main body 310 (would appear as seen in FIG. 33 with surfaces 312*d*, 312*h* of equal dimensions but oppositely tapered). In such an event the radial inner rib may be milled with a milling too rotating about axially extending axes to mill away the inner rib material to the inner circumferential surface portion of the main body 310 and that after a subsequent operation form leading and trailing surface 312*p* and 312*b* of the respective scallop 312; the axes of rotation of the tool being radially inwardly of the main body. This leaves the axial surface 321*r* for each scallop that is curved about the central axis of the ring. Excess material may be removed from the thus partially formed scallops by filing at angles of, for example 45–70 degrees and advantageously 60 degrees to leave axial outer leading and trailing surfaces 312*m*, 312*w* and corresponding axially inner but opposite sloped surfaces (not shown) together with surfaces 312*b*, 312*p*. The surface portions of each scallops 312*d*, 312*r* and 312*h* would be left from the originally radial inner rib, if the scallops were formed as set forth in this paragraph.

Each of the scallops has surfaces 312*m*, 312*w* sloping axially inwardly, radially inwardly and circumferentially toward one another so as to direct any solid material that would tend to collect on the scallops axially inwardly and circumferentially between the scallops rather than collect on generally transverse ledges or on a radially inner rib if not formed with scallops such as described when the plunder abuts against the ring to block axial inward flow in the bypass channel. The axial inner surfaces of the scallops (ones axially inwardly of surfaces 312*b*, 312*r*, 312*p* are sloped radial outwardly in an axial inner direction to minimized the retention of material (dirt or rock) between the ring and the plunger when the plunger is seated on the ring (surface 217*b* abutting against surfaces 312*d*). At the same time sufficient ring material is left in the scallops to block axial inward movement of the plunger until the desired axial inward fluid pressure build up occurs for moving the plunger axially inwardly of the ring. At the time surface 217*b* seats on the scallops, the inner piston 218 is axially intermediate ports 203 and ports 204.

When-the indicating ring is in its relaxed condition in the chamber 304, the radius of curvature of the surfaces 312*r* is sufficiently less than the radius of each of the bore 202 and the piston portion 217*c* that there has to be a desired pressure build up to move the valving mechanism axially inwardly of that shown in FIG. 32. That is when the ring is in its relaxed condition, the scallops protrude radially inwardly of the wall surface defining bore 202. When the axial inward fluid pressure acting primarily on the inward piston 218 and may in part act on the outer piston has increased sufficiently, the outer piston in abutting against the tapered scallop surfaces 312*d* forces the ring 309 to radially expand sufficiently that the valving mechanism moves axially inwardly of the ring to seat on the plunger shoulder 234. The expansion of the ring is resisted by the rubber backing 307, the rib 311 in abutting against the rubber backing resulting in the rubber backing being compressed as the indicating ring expands. Due to the rib 311 being radially elongated and having its minor base, which advantageously is of an axial dimension less than a third of that of the ring, most closely adjacent to the rubber backing, the amount of the rubber backing that has to be displaced is minimized. By replacing one rubber backing member with another one of the same composition but of a larger radial dimension (greater thickness), the fluid pressure required to force the outer piston through the indicating ring and thereby move the plunger axially inwardly of the FIG. 32 position, is increased.

The rubber backing not only serves to prevent dirt getting radially outwardly of the ring, but also to resist expansion of the ring while permitting sufficient expansion occurring to permit the outer piston moving axially therethrough, and to center the ring in the chamber 304.

Instead of using different thicknesses of rubber backing for changing the fluid pressure requirement for forcing the valving mechanism through the expandable ring, desirably ring 309 may be replaced with another one having the combined radial thicknesses of the radial outer rib 311 and the rectangular portion 310 remaining the same, but the radial thickness of the rectangular portion inversely varied relative to the radial dimension of the radial outer rib while the inner diameter of portion 310 and the radial thicknesses of the scallops remain the same. Thus the rubber backing may remain in place while, if it is desired that a greater axial inner force be required to move the valving mechanism through the ring, the replacement ring 309 would have its portion 310 of a greater radial thickness with the radial inner dimension of portion 310, the outer diameter of the outer rib 311 and the inner diameter of portion 310 remaining the same as that of the ring that it replaced. For example, with the radial thickness of portion 310 increased and the radial dimension of the radial outer rib 311 being decreased by the same amount as the increase of the radial thickness of portion 310, the outer diameter of the radial outer rib would remain the same, but a greater force would be required for expanding the ring and, accordingly, for having the valving mechanism moved axially through the ring than it would have been with the ring that was replaced.

What is claimed is:

1. Wire line drilling apparatus having a central axis and being movable inwardly through the drill string to seat on a drill string landing shoulder and latchingly engage a drill string latch seat, comprising an axially extending latch body having an outer end portion, an inner end portion and a shoulder seatable on the landing shoulder, a drilling tool mounted to the latch body to extend axially inwardly thereof, a latch assembly comprising a generally transverse latch pivot having a generally transverse pivot axis and a latch mounted by the latch pivot for pivotal movement about the pivot axis for movement relative to the latch body between a latch seated position seatable in the latch seat to block retraction of the latch outwardly through the drill string and a retracted position permitting the latch body moving axially through the drill string, and retractor means mounted to the latch body for limited axial movement relative to the latch body for moving the latch from the seated position to the retracted position, the retractor means having an axial outer overshot coupling portion and axial inner portion means for acting in cooperation with the latch body to mount the latch assembly, including the latch pivot, for significant limited axial and transverse movement relative to the retractor means, the latch body and the inner portion means having axial parts adjacent the latch pivot, the latch pivot throughout its entire transverse dimension being transversely spaced from both the retractor means and the latch body and radially inwardly of the axial adjacent parts of each of the inner portion means and the latch body, including during the pivotal movement of the latch between the latch positions, the latch body and retractor means having an axially extending central axis.

2. The wire line core barrel apparatus of claim 1 further characterized in that the latch has an axially elongated leg and an axially inner, lateral section joined to said leg and being seatable in the latch seat, said lateral section being axially inwardly of the latch pivot and axially outwardly of the latch body shoulder and extending substantially further radially outwardly of the central axis than at its juncture to said leg.

3. The wire line core barrel apparatus of claim 1 further characterized in that the latch assembly includes a second generally transverse latch pivot in transverse spaced relationship to the first latch pivot and having a second generally transverse pivot axis in transverse spaced relationship to the first pivot axis and a second latch mounted by the second latch pivot for pivotal movement about the second pivot axis for movement relative to the latch body between a latch seated position seatable in the latch seat to block retraction of the latch outwardly through the drill string and a retracted position permitting the latch body moving axially through the drill string, and transversely extending connecting means for mounting the latch pivots in transversely spaced relationship.

4. The wire line core barrel apparatus of claim 3 further characterized in that the connecting means consist of a rigid link mounting the latch pivots in fixed transverse relationship to one another while permitting one latch pivoting relative to the other, said link having a first end portion mounting the first pivot and a transverse opposite second end portion mounting the second pivot.

5. The wire line core barrel apparatus of claim 1 further characterized in that the inner portion means defines a downwardly opening latch assembly chamber including an axially extending retractor tubular portion having the latch pivot located therein, and that the latch includes a latch leg extending within the chamber and having an axial outer portion mounted to the latch pivot.

6. The wire line core barrel apparatus of claim 5 further characterized in that the tubular portion has a transverse annular, axial inner terminal edge having the latch leg extending axially therethrough, the tubular portion having an axially outer, generally cylindrical, transverse inner axial wall portion in transverse surrounding relationship to the pivot and a flange axially inwardly of the inner wall portion and extending further radially inwardly than the inner axial wall portion for abutting against the leg to move the latch from its latch seated position to its latch retracted position as the retractor moves axially outwardly relative to the latch body.

7. The wire line core barrel apparatus of claim 5 further characterized in that latch body outer portion comprises an annular, outer tubular end portion opening outwardly and having the inner portion means mounted therein for limited axial movement, and an inner transverse wall, the latch body tubular portion having a latch slot for having the latch extending transversely therethrough, that the retractor tubular portion has an axially inner transverse terminal edge axially outwardly of the inner transverse wall and at least in part axially outwardly of the slot, and that the latch has a lateral section joined to the latch leg axially inwardly of the pivot and the terminal edge and extending through the latch slot in the latch seated position.

8. The wire line core barrel apparatus of claim 7 further characterized in that the inner portion means has a transverse wall defining part of the chamber axially outwardly of the terminal edge that in combination with at least one of the slot and the terminal edge and the latch body wall are of an axial spacing to permit substantial movement of the retractor means outwardly of latch assembly and limiting the movement of at least one of the latch assembly and the retractor means inwardly relative to the latch body.

9. The wire line core barrel apparatus of claim 7 further characterized in that the latch assembly includes a second latch pivot having a second pivot axis substantially parallel to and transversely spaced from the first pivot and a second latch having an axial outer end portion mounted by the second pivot for pivotal movement of the second latch about the second pivot axis between a latch seated position and a latch retracted position and means for mounting the latch pivots and retaining the latch pivots in transverse spaced relationship, each of the latches having an axial inner end portion, a transverse stop member mounted by one of the latch body and the retractor means to extend between the inner end portions of the latches for limiting the pivotal movement of the latches toward one another and the rotation of the latch assembly relative to the retractor means and axial movement of the retractor means relative to the latch assembly for maintaining the latch assembly at least in part extending into the chamber.

10. Wire line drilling apparatus having an axial extending central axis and being movable inwardly through a drill string to seat on a drill string landing shoulder and latchingly engage a drill string latch seat, comprising an axially extending latch body having an outer end portion, an inner end portion and a shoulder seatable on the landing shoulder, a drilling tool mounted to the latch body to extend axially inwardly thereof, an axially extending latch retractor having an outer overshot coupling portion and an inner latch mounting portion that includes means defining an inwardly opening chamber, the retractor having an axially extending central axis, a latch assembly for releasably retaining the latch body in the drill string and having at least an axial outer end portion located in the chamber for free rotation about the retractor central axis relative to the retractor and the latch body and free floating axial movement relative to the retractor, the latch assembly including first and second latches pivotally movable at least predominantly transverse between latch seated and latch retracted positions and having axial outer end portions in the chamber and axial opposite inner end portions for removably engaging the latch seat, and connecting means within the chamber and mounted to the latch outer end portions for mounting the latches for pivotal movement about at least one transverse pivot axis between the latch positions, and means for mounting the retractor to the latch body for limited axial movement relative thereto, the the chamber defining means including means for moving the latches to the latch retracted positions as the retractor is moved axially outwardly relative to the latch body.

11. The wire line core barrel apparatus of claim 10 further characterized in that the connecting means comprises a rigid link having a first transverse end portion and a second transverse end portion, a first pivot having a first transverse pivot axis and being mounted by the first latch outer end portion, a second pivot having a second transverse pivot axis and being mounted by the second latch outer end portion, the first and second pivots being mounted by the respective first and second link and portion to mount the first and second latches for pivotal movement about the first and second axes respectively, said rigid link being transversely and radially spaced from each of the latch body and the retractor.

12. The wire line core barrel apparatus of claim 11 further characterized in that the latch body has latch slots for the latches to extend through when the latches are in their latch seated position and there is provided a stop member mounted by the latch body to extend transversely intermediate the inner end portion of the latches to limit the movement of the latches in a direction toward the latches retracted positions and limit rotation of the latch assembly in the chamber when the latches are retracted from extending within the latch body slots.

13. The wire line core barrel apparatus of claim 11 further characterized in that the means defining the chamber comprises an axial outer, diameter opposite chamber portions radially opposite the pivots and that the means for moving the latches comprises a first and second flange diametrically opposite the other and radially extending toward the other with the latches extending axially therebetween for abutting against the first and second latches respectively to retract the latches as the retractor is moved axially outwardly, said flanges being of a substantially smaller diametric spacing than the diametric opposite chamber portions, and a spring acting against both the first and second latches to constantly resiliently urge the latches toward their latch seated position.

14. The wire line core barrel apparatus of claim 11 further characterized in that the latch body outer end portion comprises a tubular portion opening axially outwardly and having the retractor extended thereinto, the retractor having a shoulder abuttable against the tubular portion to limit the inward movement of the retractor relative to the latch body, that the latches are mounted on the pivots directly diametrically opposite one another, the latches outer end portions being axially elongated legs and the latches inner end portions being lateral sections extending radially away from the respective leg in a direction opposite the other lateral section and being axially inwardly of the retractor, and that the latch body has diametric opposite slots for the latches in their latch seated position have their lateral sections extend radially outwardly therethrough and radially outwardly of the latch body.

15. The wire line core barrel apparatus of claim 10 further characterized in that the connecting means comprises a rigid link having a first transverse end portion and a second transverse end portion, a first pivot having a first transverse pivot axis and being mounted by the first latch outer end portion, a second pivot having a second transverse pivot axis and being mounted by the second latch outer end portion, the first and second pivots being mounted by the respective first and second link end portion to mount the first and second latches for pivotal movement about the first and second axes respectively, and that the latches have axial inner, radial inner corner portions that during the initial movement of the latches from their latched seated position is slightly axially inwardly and primarily radially toward the central axis.

16. Wire line drilling apparatus having a central axis and being movable inwardly through the drill string to seat on a drill string landing shoulder and latchingly engage a drill string latch seat, comprising an axially extending latch body having an outer end portion, an inner end portion and a shoulder seatable on the landing shoulder, a drilling tool mounted to the latch body to extend axially inwardly thereof, an axially extending latch retractor having an outer overshot coupling portion and an inner latch mounting portion that includes means defining a latch chamber, the retractor having an axially extending central axis, limiting means for mounting the retractor to the latch body to extend outwardly of the latch body and for limited axial movement relative to the latch body, and a latch assembly at least in part located in the chamber, the latch assembly including first and second latches pivotally movable at least predominantly transversely between latch seated and latch retracted positions and having first end portions in the chamber and second end portions for removably engaging the latch seat, and a rigid transverse link in the chamber and having a first transverse end portion and a second transverse end portion radially opposite the central axis from the link first end portion, said link being movable relative to the latch body, a first transverse pivot having a first pivot axis for mounting the first latch first end portion to the link first end portion for pivotal movement about the first pivot axis and a second transverse pivot having a second pivot axis parallel to the first pivot axis for mounting the second latch first end portion to the link second end portion for pivotal movement about the second pivot axis, the pivots mounting the latches for pivotal movement between the latch positions, the retractor having means for moving the latches to the latch retracted positions as the retractor is moved axially outwardly relative to the latch body.

17. The wire line core barrel apparatus of claim 18 further characterized in that the pivots and link are transversely and radially spaced from both the latch body and the retractor to permit the retractor to move axially outwardly relative to the latch assembly as the retractor is moved axially outwardly and the latches are moved to their retracted positions and that the latch body has wall means to limit inward movement of the latch assembly and that the means defining the chamber includes a surface portion for limiting the outward movement of the latch assembly relative to the retractor.

18. The wire line drilling apparatus of claim 17 further characterized in that the chamber defining means defines a transverse wall portion abuttable against the latch assembly for limiting the axial outward movement of the latch assembly relative to the retractor and an axially outer, circular cylindrical wall portion extending axially intermediate the transverse wall portion and the latch retracting means, the latch retracting means extending more closely adjacent to the central axis than the radial spacing of the cylindrical wall portion from the central axis.

19. The wire line drilling apparatus of claim 18 further characterized in that the latch retracting means includes diametrically opposite, transversely arcuately curved first and second flanges in angular spaced relationship to one another, and the chamber defining means includes arcuately curved wall sections of about the same diameter as the cylindrical axial wall portion and of greater diameters than the minimum diametric spacing of the flanges to extend arcuately between the flanges, the arcuate transverse dimensions of the arcuate wall sections being sufficiently great to permit the latch assembly being axially inserted into the chamber with the latch first end portions arcuately between the flanges and the link extending transversely and after insertion, permit the latch assembly being rotated about the central axis to have the latch portions diametrically between the flanges.

20. The wire line drilling apparatus of claim 19 further characterized in that the latch assembly includes a spring for constantly resiliently urging the latches to pivot toward their latch seated position, that the latch body outer end portion has an axial outer tubular portion having the retractor inner end portion extended thereinto and an axial inner transverse wall section axially spaced from the retractor in the limited positions of the retractor relative to the latch body, the latch second end portions in their latch seated positions extendinq axially between the flanges and the latch body transverse wall section and that there is provided a stop member mounted by the latch body axially outwardly of the transverse wall and axially inwardly of the flanges to extend transversely between the latches to limit each of the latches inner sections to a maximum retracted position independent of the retracting movement of the other latch.

21. The wire line drilling apparatus of claim 20 further characterized in that the latch second end portions are axially inwardly of the latch pivots, and that with the latches in a latch seated position, during the initial retraction of the retractor, in an axial plane containing the central axis and extending perpendicular to the latch pivots, the radial spaced of the point of contact of the flanges with the latches to the pivot axes is at least about 10 times the minimum transverse spacing of the point of contact from a line passing through the respective latch pivot axis and parallel to the central axis.

22. For wire line drilling apparatus, an axially elongated wire line latch body having axial inner and outer ends, the latch body having a tubular retractor mounting portion opening axially outwardly, a latch retractor axially movably extended into the tubular portion and having an overshot coupling portion for retracting the latch body and a latch chamber axially inwardly or the overshot coupling portion, the latch body and retractor having a central axis, a latch assembly at least in part retained in the retractor chamber, the latch assembly including a first and a second latch pivotally movable between a latch seat engaging position for blocking removal of the latch body and a retracted position permitting axial withdrawal movement of the latch body, and connecting means for attaching the latch retractor to the latch body for limited axial movement relative thereto between a latch seating position and a latch retracting position and in moving to the latch retracting positions retracting the latches, the latches each having a laterally extending latch seat engaging lateral section extendable radially outwardly of the latch body and a latch leg joined to the latch seat engaging section to extend axially away from the latch seat engaging section, a transverse link mounted in the chamber for axial movement relative to the retractor as the retractor is axially moved outwardly relative to the latch body and having a first end portion radially spaced from the central axis and a second end portion radially spaced from the central axis and diametrically opposite the central axis from the link first end portion, a first transverse pivot having a first transverse pivot axis and mounted to the first latch leg axially remote from the first latch section, mounted to the link first end portion for axial movement with the link and mounting the first latch for pivotal movement about the first pivot axis between the latch assembly positions, and a second transverse pivot having a second transverse pivot axis, mounted to the second latch leg axially remote from the second latch section and to the link second end portion to move axially with the link and mounting the second latch for pivotal movement about the second pivot axis between the latch assembly positions.

23. The apparatus of claim 22 further characterized in that the latch body has first and second diametric portions, the first diametric portion being axially outwardly of the second diametric portion, of a larger diameter than the second diametric portion, and joined to the second portion to form an axially inwardly facing shoulder, the latch body having a fluid bypass channel that includes a first port opening exterior of the latch body outwardly of the shoulder and a second port opening exterior of the latch body inwardly of the shoulder, and that the latches are pivotally mounted to the respective pivot for having the first latch lateral section located on the same diametric side of the central axis as the first pivot in both of the first latch section latch seating and retracted positions.

24. The apparatus of claim 22 further characterized in that each of the latches has axially extending side surfaces on transverse opposite sides of an axial plane containing the central axis and extending perpendicular to the pivot axes.

25. The apparatus of claim 22 further characterized in that the link is a rigid link, that the latch body has an inner portion joined to the tubular portion to extend inwardly thereof and having a transverse wall at the juncture with the tubular portion, the tubular portion having diametrically opposite latch slots adjacent to the juncture of the latch body inner portion to the tubular portion for the latch lateral section to extend transversely outwardly therethrough in the latch seatable position, that the retractor has diametrically opposite flanges extending radially toward one another with the latches extending axially therebetween for retracting the latches as the retractor is moved outwardly relative to the latch body, that the chamber opens axially to open the latch body transverse wall and axially outwardly of the flanges is of a diameter greater than the minimum diametric spacing of the flanges and slightly greater than the maximum transverse dimension of the link, that the latch lateral sections in both of the latch assembly positions are located axially between the flanges and the transverse wall and that there is provided a transverse stop member mounted by the latch body to extend transversely between the latch lateral sections to limit transverse movement of each latch section toward the other to the latch retracted positions.

26. The apparatus of claim 22 further characterized in that there is provided drill string fluid sealing mechanism on at least one of the latch body and the retractor outwardly of the lateral sections, that at least one of the retractor and the latch body has relatively axially movable fluid bypass means for defining a closable fluid bypass channel that is open when the latch assembly is in its latch seated engaging position and has a closed position when the latch assembly is in its latch retracted position, the bypass means having one end opening exterior of the retractor and latch body axially outwardly of the seal mechanism and an opposite end opening exterior of the retractor and latch body axially inwardly of the seal mechanism, and means cooperating with the latches for retaining the fluid bypass means in its closed position when the latch is in its retracted position and permitting the fluid bypass means to open when the latch assembly is in its latch seated position.

27. The apparatus of claim 26 wherein the fluid bypass means opposite end comprises a port in the latch body and a retractor port that opens to the latch body port when the latch assembly is in its latch seated position and opens to the latch body axially spaced from the latch body port for being blocked by the latch body when the latch assembly is in its retracted position and the fluid bypass means one end opens through the retractor axially remote from the latch body in each of the latch assembly positions, and the means cooperating with the latches comprises an underground member connected to the latch body for movement therewith and movement relative to the latch assembly.

28. Wire line drilling apparatus having a central axis and being fluidly propellable inwardly through a drill string to seat on a drill string landing shoulder and latchingly engage a drill string latch seat when the drilling apparatus is adjacent to the latch seat, comprising an axially extending latch body having an outer end portion, an inner end portion and a shoulder seatable on the landing shoulder, a drilling tool mounted to the latch body to extend axially inwardly thereof, a latch assembly comprising a generally transverse latch pivot having a generally transverse pivot axis and a latch mounted by the latch pivot for pivotal movement about the pivot axis for movement relative to the latch body between a latch seated position seatable in the latch seat to block retraction of the latch body outwardly through the drill string and a retracted position permitting the latch body moving axially through the drill string, retractor means mounted to the latch body for limited axial movement relative to the latch body from a first relative position permitting the latch moving to its latch seated position to a second relative position for moving the latch from the latch seated position to the latch retracted position, the retractor means having an axial outer overshot coupling portion and axial inner portion means for acting in cooperation with the latch body to mount the latch assembly, including the latch pivot, for significant limited axial and transverse movement relative to the retractor means, the latch pivot throughout its entire transverse dimension being transversely and radially spaced from both the retractor means and the latch body, including during the pivotal movement of the latch between the latch positions, annular fluid seal means mounted on one of the latch body and the retractor means axially outwardly of the latch body shoulder to form a fluid seal with the drill string and the one of the latch body and the retractor means on which it is mounted, bypass means axially movable relative to the seal means and defined at least in part by one of the latch body and retractor means for permitting fluid flow axially bypassing the seal means when the latch is in its seated position and the retractor means is in its first position and preventing fluid bypass flow when the retractor means is in its second position, and stop means for cooperating with the bypass means and the latch for retaining the bypass means in a position to block bypass flow while the apparatus is being propelled inwardly and until the latch has moved to its latch seated position and when the latch has moved to its latch seated position, permit the bypass means allowing fluid to bypass the seal means.

29. The apparatus of claim 28 further characterized in that the latch body has a latch slot for the latch to extend transversely therethrough and transverse outwardly thereof in the latch seated position, that the latch has a cutout defining an outwardly facing latch shoulder transversely more closely adjacent to the central axis than the latch slot, and that the stop means has an axially elongated portion seatable on the latch shoulder when the latch is in its retracted position for retaining the bypass means in a relative axial position to prevent fluid bypass flow as the drilling apparatus is being fluidly propelled inwardly, the latch in moving from its retracted position to its latch seated position moving the latch shoulder relative to the stop means portion to permit the stop means moving axially inwardly of the latch shoulder and permitting the retractor means moving to its first position to permit bypass flow.

30. The apparatus of claim 28 further characterized in that the bypass means comprises a latch body port, and a retractor means bypass channel having an opening that opens exterior of the retractor means axially outwardly of the seal means and a second end that opens to the latch body port when the latch is in its latch seated position, and is blocked by the latch body when the latch has been retracted and the drilling apparatus is being fluidly propelled inwardly, that the latch body has an axially elongated slot axially outwardly of the latch slot and that the retractor means includes a latch retractor having the overshot coupling portion and a pin mounted by the retractor in a fixed axial position relative to the retractor for movement therewith and extended into the elongated slot to limit the axial movement of the retractor relative to the latch body, said pin mounting the stop means to move axially therewith and axially inwardly of the pin.

31. Wire line drilling apparatus movable inwardly through a drill string to seat on a drill string landing shoulder and latchingly engage a drill string latch seat, comprising an axially extending latch body having a central axis, an outer end portion, an inner end portion, a shoulder seatable on the landing shoulder, and a fluid bypass channel having an axially extending first bore portion, a first port opening transversely toward the drill string axially outwardly of the shoulder and to the first bore portion, and a second port opening transversely toward the drill string axially inwardly of the shoulder and to the first bore portion axially inwardly of the first port opening to the first bore portion and in axial spaced relationship to the opening of the first port to the first bore portion, an axially extending latch retractor having an outer overshot coupling portion, the retractor having an axially extending central axis, limiting means for mounting the retractor to the latch body to extend outwardly of the latch body and for limited axial movement relative to the latch body, and a latch assembly mounted by at least one of the latch body and the retractor, the latch assembly including a first latch pivotally movable between latch seated and latch retracted positions and having a first end portion and a second end portion for removably engaging the latch seat the latch body having, a second axial extending bore portion having a first end opening to the first latch when the latch is in its retracted position and a second end portion opening to the first bore portion, first valving means extending within the bore for axial movement to control fluid flow through the bypass channel and provide a high pressure signal only after the latch body has seated on the landing shoulder and the latch has latchingly engaged the latch seat, the latch assembly and first valving means having cooperating means for couplingly engaging the first valving means to the latch assembly when the latch is in the latch retracted position to retain the valving means in a position permitting substantial fluid flow through the bypass channel as the latch body moves axially inwardly through the drill string, upon being seated upon the landing shoulder and after the latch moving to its latch seated position, releasing the coupling engagement allowing movement of the first valving means in the bore to a position blocking substantial fluid flow through the bypass channel until an inward direct fluid pressure build up in the bore outwardly of the opening of the second port to the first bore portion to about a preselected level and thence upon the pressure build up to about the preselected level, moving to open the fluid bypass channel to permit substantial fluid flow through said bypass channel, the cooperating means including a valving means head and a latch assembly valving head coupling engaging means for couplingly engaging the valving means head until the latch is in its latch seated position.

32. The wire line drilling apparatus of claim 31 further characterized in that the latch body has an inner peripheral wall defining the bore, that the first valving means includes an outer piston portion, an inner piston portion forming a close fluid fit with the latch body peripheral surface, and a valve stem portion of a reduced diameter, joined to the piston portions and being of an axial length to retain the piston portions in axial spaced relationship that is greater than the minimum axial spacing of the openings of the ports to the first bore portion, and that the bore has a plunger seat for limiting the axial inward movement of the valving mechanism relative to the bore to a position that the inner port opens to the first bore portion axially outwardly of the inner piston portion and the outer port opens to the first bore portion axially inwardly Of the Outer piston portion to permit flow in the bore between the inner and outer ports when the first valving means seats on the plunger seat.

33. The wire line drilling apparatus of claim 31 further characterized in that a stop member is mounted by the latch body in fixed relationship thereto for limiting the pivoting of the latch away from its latch seated position and the first valving means axially outwardly in the bore by abutting thereagainst that the first valving means has valving mechanism that includes a valve portion and resilient means for abutting against the stop pin to resiliently urge the valving portion axially inwardly of the stop pin, that the valving means head includes at least one axial outer tang extending transversely outwardly of the stop member when the valving mechanism abuts against the stop member and that the latch assembly coupling engaging means comprises the latch second end portion having a recess for the tang extending thereinto and to provide a latch portion extending axially inwardly of the tang to block axial inward movement of the valving mechanism relative to the latch body when the latch is retracted and the latch body is moving axially inward in the drill string.

34. The wire line drilling apparatus of claim 31 further characterized in that the latch body has an inner peripheral wall defining the bore, that the first valving means includes an inner piston portion forming a close fluid fit with the latch body peripheral surface, said piston portion being located axially outwardly of the first port when the valving means head is couplingly engaged by the latch assembly coupling engaging means, axially intermediate the openings of the first and second ports to the first bore portion when the first valving means is in its position blocking substantial fluid flow and inwardly of the opening of the second bore portion to the first bore portion to open the fluid bypass channel after the first valving means has moved to its position blocking substantial fluid flow.

35. The wire line drilling apparatus of claim 34 further characterized in that the latch assembly includes a second latch pivotally movable between latch seated and latch retracted positions and a first end portion and a second end portion for removably engaging the latch seat, each latch first end portion being axially outwardly of the respective latch second end portion, a rigid transverse link having first and second transversely opposite ends, a first pivot pivotally connecting the first latch first end portion to the link first end portion and a second pivot pivotally connecting the second latch first end portion, and a transverse stop pin mounted to the latch body to extend transversely between the latch second end portions for limiting the transverse pivotal inward movement of each latch second end portion toward the other and the central axis, and the axial outward movement of the first valving means toward the latch assembly pivots.

36. Wire line drilling apparatus movable inwardly through a drill spring to seat on a drill string landing shoulder and latchingly engage a drill string latch seat, comprising an axially extending latch body having a central axis, an outer end portion, an inner end portion, a shoulder seatable on the landing shoulder, a fluid bypass channel having an axially extending first bore portion, and a transverse inner, outwardly facing plunger shoulder axially inwardly of the fluid bypass channel, a first port opening transversely toward the drill string axially outwardly of the shoulder and to the first bore portion, and a second port opening transversely toward the drill string axially inwardly of the shoulder and to the first bore portion axially inwardly of the first port opening to the first bore portion and in axial spaced relationship to the opening of the first port to the first bore portion, an axially extending latch retractor having an outer overshot coupling portion, the retractor having an axially extending central axis, limiting means for mounting the retractor to the latch body to extend outwardly of the latch body and for limited axial movement relative to the latch body, and a latch assembly mounted by at least one of the latch body and the retractor, the latch assembly including a first and a second latch pivotally movable between latch seated and latch retracted positions and each having an end portion for engaging the latch seat, a second axial extending bore portion having a first end opening to the first latch when the latch is in its retracted position and a second end portion opening to the first bore portion first valving means extendinq within the bore for axial movement for controlling fluid flow through the bypass channel and provide a high pressure signal only after the latch body has seated on the landing shoulder and both latches have latchingly engaged the latch seat, and thence opening the fluid bypass channel to allow the pressure build up to decrease, the valving means including a first valving portion of reduced transverse dimension, a second end portion of a greater transverse area than the transverse area of the first valving portion and diametrically opposite head portions joined to the first valving portion to extend axially outwardly thereof and transverse outwardly of the first valving portion and each latch having a head receiving recess for receiving one of the head portions therein with the second valving portion axially inwardly of the recess when the latches are in their retracted position and the head portions extend therein, blocking axial inward movement of the valving means until the latches have moved to their latch seated position,

37. The drilling apparatus of claim 36 further characterized in that detent means are mounted by the latching body to extend transversely into the bore axially inwardly of the valving means when at least one head portion extends into the adjacent recess and after both latches have seated in their latch seated position limit the axial inward movement of the valving means to a blocking position to block fluid through the bypass channel until the pressure in at least part of the channel builds up to about a preselected level and thereafter permitting the valving means moving axially inwardly to a position to seat on the plunger shoulder and open the bypass channel to allow fluid flow through the bypass channel.

38. The drilling apparatus of claim 36 further characterized in that the latch body has an annular resilient mechanism chamber opening to the bore axially intermediate the first ports and the latch assembly and that resilient mechanism is mounted in the chamber for extending transversely into the bore at least partially axially inwardly of the valving means when at least one head portion extends into the adjacent recess and after both latches have seated in their latch seated position, limit the axial inward movement of the valving means to a blocking position to block fluid flow through the bypass channel until the pressure in at least part of the channel builds up to about a preselected level and thereafter permitting the valving means moving axially inwardly to a position to seat on the plunger shoulder and open the bypass channel to allow fluid flow through the bypass channel.

39. The drilling apparatus of claim 38 further characterized in that the resilient mechanism comprises a resilient pressure indicating ring having scallops extending radially into the bore when the head portion extend into the latch recesses.

40. Wire line drilling apparatus having a central axis and being movable inwardly through the drill string to seat on a drill string landing shoulder and latchingly engage a drill string latch seat, comprising an axially extending latch body having an outer end portion, an inner end portion and a shoulder seatable on the landing shoulder, a drilling tool mounted to the latch body to extend axially inwardly thereof, a latch assembly comprising a generally transverse latch pivot having a generally transverse pivot axis and a latch mounted by the latch pivot for pivotal movement about the pivot axis for movement relative to the latch body between a latch seated position seatable in the latch seat to block retraction of the latch body outwardly through the drill string and a retracted position permitting the latch body moving axially through the drill string, and retractor means mounted to the latch body for limited axial movement relative to the latch body for moving the latch from the seated position to the retracted position, the retractor means having an axial outer overshot coupling portion and axial inner portion means for acting in cooperation with the latch body to mount the latch assembly, including the latch pivot, for significant limited axial and transverse movement relative to the retractor means, the latch pivot throughout its entire transverse dimension being transversely spaced from both the retractor means and the latch body, including during the pivotal movement of the latch between the latch positions, the latch body and retractor means having an axially extending central axis, the latch body having a transverse outer, exterior peripheral surface, a maximum diameter portion and a reduced diameter portion extending axially inwardly of the maximum diameter portion and joined to the maximum diameter portion to form an inwardly facing landing shoulder, a fluid bypass channel for conducting fluid between a position axially outwardly of the shoulder and a position axially inwardly of the shoulder to bypass the shoulder, and a bore that has a first bore portion opening to the latch and to the bypass channel, the bypass channel including a second bore portion that is a part of the bore, an outer port opening through the peripheral surface outwardly of the shoulder and to the second bore portion and an inner port opening through the peripheral surface inwardly of the shoulder and to the second bore portion, and first valving means mounted for limited axial movement in at least one of the bore and bypass channel between positions permitting substantial fluid flow through the bypass channel and a position blocking substantial fluid flow through the bypass channel and upon a substantial increase in inwardly acting fluid pressure in the channel, move to a position inwardly of the fluid flow blocking position to allow substantial fluid bypass flow though the channel, the latch and first valving means having cooperating means for forming a coupling engagement with one another to retain the first valving means out of the position blocking substantial fluid flow through the fluid bypass channel of the fluid bypass position until the latch has moved to its latch seated position and upon the latch moving to its latch seated position, releasing the coupling engagement to allow the first valving means moving axially inwardly of the latch, and retractable means retractably extending within the bore to limit the inward movement of the first valving means upon the releasing of the coupling engagement to the position blocking the fluid bypass channel after the releasing of the first valving means, and upon the said build up of fluid pressure, permitting the first valving means moving inwardly to unblock said fluid bypass channel.

41. The wire line core barrel apparatus of claim 40 further characterized in that the first valving means includes an outer piston, an inner piston and reduced diameter stem means extending between and joined to the inner and outer pistons, the axial length of the stem means being greater than the opening of the ports to the second bore portion.

42. The wire line core barrel apparatus of claim 40 further characterized in that the cooperating means includes an axial outer head of the first valving means and valving means head receiving recess in the latch for preventing the first valving means moving axially away from the latch until the latch has moved to its latch seated position and then permitting the first valving means moving axially away from the latch and that the retractable means includes spring urged detents.

43. Wire line drilling apparatus having a central axis and being movable inwardly through the drill string to seat on a drill string landing shoulder and latchingly engage a drill string latch seat, comprising an axially extending latch body having an outer end portion, an inner end portion and a shoulder seatable on the landing shoulder, a drilling tool mounted to the latch body to extend axially inwardly thereof, a latch assembly comprising a generally transverse latch pivot having a generally transverse pivot axis and a latch mounted by the latch pivot for pivotal movement about the pivot axis for movement relative to the latch body between a latch seated position seatable in the latch seat to block retraction of the latch outwardly through the drill string and a retracted position permitting the latch body moving axially through the drill string, and retractor means mounted to the latch body for limited axial movement relative to the latch body for moving the latch from the seated position to the retracted position, the retractor means having an axial outer overshot coupling portion and axial inner portion means for acting in cooperation with the latch body to mount the latch assembly, including the latch pivot, for significant limited axial and transverse movement relative to the reactor means, the inner portion means defining a downwardly opening latch assembly chamber including an axially extending retractor tubular portion having the latch pivot located therein, the latch including a latch leg extending within the chamber and having an outer portion mounted to the latch pivot, the latch pivot throughout its entire transverse dimension being transversely spaced from both the retractor means and the latch body, including during the pivotal movement of the latch between the latch positions, the latch body and retractor means having an axially extending central axis, the latch body outer portion comprising an annular, outer tubular end portion opening outwardly and having the inner portion means mounted therein for limited axial movement, and an inner transverse wall, the latch body tubular portion having a latch slot for having the latch extending transversely therethrough, the retractor tubular portion having an axially inner transverse terminal edge axially outwardly of the inner transverse wall and at least in part outwardly of the slot, and the latch having a lateral section joined to the latch leg inwardly of the pivot and the terminal edge and extending through the latch slot in the latch seated position, the latch assembly including a second latch pivot having a second pivot axis substantially parallel to and transversely spaced from the first pivot and a second latch having an outer end portion mounted by the second pivot for pivotal movement of the second latch about the second pivot axis between a latch seated and a latch retracted position and means for mounting the latch pivots and retaining them in transverse spaced relationship, a transverse stop member mounted by one of the latch body and the retractor means for limiting the pivotal movement of the latches toward one another to limit the rotation of the latch assembly relative to the retractor means and axial movement of the retractor means relative to the latch assembly for maintaining the latch assembly at least in part extending into the chamber, the second latch having a latch leg, each latch leg having a radially outer, axially elongated surface diametric opposite the elongated surface of the other latch leg, the retractor means tubular portion having an axially outer, generally circular cylindrical, transverse inner axial wall portion in transverse surrounding relationship to the pivots and diametric opposite, angularly spaced axially inner flanges extending further radially inwardly than the inner axial wall and abuttable against the transversely adjacent leg radial outer surface for moving the latches from their latch seated position to their latch retracted position as the retractor means moves axially outwardly relative to the latch body and arcuate walls sections between the flanges of sufficient angular dimensions to permit the latch assembly axially being moved transversely between the flanges to have the latch legs extended into and the latch pivots located within the chamber when the stop member is removed from the latch body and the retractor, and the retractor is removed from the latch body and the latch assembly is rotated about the retractor means central axis for having the latch pivot angularly adjacent to the arcuate wall sections and transversely between the flanges and then rotated about the retractor means central axis to have the legs in diametric transverse alignment with the flanges.

44. The wire line core barrel apparatus of claim 43 further characterized in that the tool comprises one of a core receiving tube and a drag bit.

* * * * *

UNITED STATES PATENT AND TRADEMARK OFFICE

CERTIFICATE OF CORRECTION

PATENT NO. : 5,267,620

DATED : December 7, 1993

INVENTOR(S) : Kevin J. Lee

It is certified that error appears in the above-identified patent and that said Letters Patent is hereby corrected as shown below:

Column 1, line 36, after "upwardly", insert --,--; and and line 55, change "Connected" to --connected--.
Column 6, line 35, change "inn-r" to --inner--.
Column 7, line 35, change "Circularly" to --circularly--.
Column 14, line 60, change "in" to --an--.
Column 15, line 38, change "B3" to --83--.
Column 16, line 61, change "tang" to --tangs--.
Column 17, line 48, change "Of" to --of--.
Column 21, line 20, change "30" to --309--; and line 48, change "too" to --tool--.
Column 25, line 46, change "and" to --end--.
Column 27, line 11, change "18" to --16--.
Column 28, line 7, change "spaced' to --spacing--.
Column 29, line 19, after "axially", insert --inwardly--.
Column 32, line 13, change "Of" to --of--; and line 14, change "Outer" to --outer--.
Column 32, line 22, after "thereagainst", insert --,--.
Column 33, line 32, after "portion", insert --,--.
Column 35, line 62, change "reactor" to --retractor--.

Signed and Sealed this

Twelfth Day of July, 1994

*Attest:*

*Attesting Officer*

BRUCE LEHMAN

*Commissioner of Patents and Trademarks*